US007415781B2

(12) United States Patent
Barron et al.

(10) Patent No.: US 7,415,781 B2
(45) Date of Patent: Aug. 26, 2008

(54) FABRIC ARTICLE TREATING APPARATUS WITH SAFETY DEVICE AND CONTROLLER

(75) Inventors: Bradford Scott Barron, Cincinnati, OH (US); Mary Jane Combs, Covington, KY (US); Dean Larry DuVal, Lebanon, OH (US); Keith David Fanta, Middletown, OH (US); Paul Amaat Raymond Gerard France, West Chester, OH (US); Christian Gerhard Friedrich Gerlach, Brussels (BE); Laura Lynn Heilman, Cincinnati, OH (US); Eugene Joseph Pancheri, Cincinnati, OH (US); Paul Joseph Russo, Loveland, OH (US); Christopher Lawrence Smith, Liberty Township, OH (US); Pedro Vincent Vandecappelle, Izegem (BE)

(73) Assignee: The Procter and Gamble Company, Cincinnati, OH (US)

( * ) Notice: Subject to any disclaimer, the term of this patent is extended or adjusted under 35 U.S.C. 154(b) by 0 days.

(21) Appl. No.: 11/592,359

(22) Filed: Nov. 3, 2006

(65) Prior Publication Data

US 2007/0094888 A1 May 3, 2007

Related U.S. Application Data

(60) Division of application No. 10/697,735, filed on Oct. 29, 2003, now Pat. No. 7,146,749, which is a continuation-in-part of application No. 10/418,595, filed on Apr. 17, 2003, now Pat. No. 7,059,065.

(60) Provisional application No. 60/426,438, filed on Nov. 14, 2002, provisional application No. 60/374,601, filed on Apr. 22, 2002.

(51) Int. Cl.
*F26B 11/02* (2006.01)

(52) U.S. Cl. ..... 34/595

(58) Field of Classification Search ..... 34/595
See application file for complete search history.

(56) References Cited

U.S. PATENT DOCUMENTS 2,079,280 A 5/1937 Couch (Continued)

FOREIGN PATENT DOCUMENTS

DE 23 18 596 B2 4/1980

(Continued)

OTHER PUBLICATIONS

U.S. Appl. No. 11/592,359, filed Nov. 3, 2006, Barron et al.

(Continued)

*Primary Examiner*—S. Gravini
(74) *Attorney, Agent, or Firm*—Julia A. Glazer; Kim William Zerby; Brent M. Peebles

(57) ABSTRACT

A fabric article treating apparatus for dispensing a benefit composition through a nozzle that directs the benefit composition as droplets or particles into the chamber of the fabric article drying appliance. The droplets or particles provide benefits to the fabric articles within the drying appliance. The treating apparatus includes one or more safety features, and/or it includes beneficial control concepts that enhance the effects of the benefit composition being dispensed through the nozzle.

16 Claims, 12 Drawing Sheets

U.S. PATENT DOCUMENTS 2,807,893 A 10/1957 Morey
2,812,593 A 11/1957 Olthuis
2,846,776 A 8/1958 Clark
2,851,791 A 9/1958 Olthuis
2,873,539 A 2/1959 Morey
2,941,309 A 6/1960 Cobb
2,958,954 A 11/1960 Longenecker
3,002,288 A 10/1961 Conlee
3,022,580 A 2/1962 Doty
3,103,450 A 9/1963 Janson
3,114,653 A 12/1963 Kruzan
3,172,604 A 3/1965 Brock
3,180,037 A 4/1965 Kenreich et al.
3,239,947 A 3/1966 Kenreich et al.
3,267,701 A 8/1966 Mandarino
3,364,585 A 1/1968 Fish
3,583,180 A 6/1971 Arbogast
3,595,036 A 7/1971 Laddle
3,634,947 A 1/1972 Furgal
3,816,070 A 6/1974 Candor et al.
3,872,604 A 3/1975 Keller
4,009,598 A 3/1977 Bernard et al.
4,014,105 A 3/1977 Furgal et al.
4,022,938 A 5/1977 Zaki et al.
4,098,937 A 7/1978 Mizuno et al.
4,207,683 A 6/1980 Horton
4,236,320 A * 12/1980 Schwadike et al. ..... 34/428
4,242,377 A 12/1980 Roberts et al.
4,341,347 A 7/1982 DeVittorio
4,501,682 A 2/1985 Goodman et al.
4,511,495 A 4/1985 Melville
4,532,722 A 8/1985 Sax
4,567,675 A 2/1986 Rennie
4,579,279 A 4/1986 Marchant
4,618,099 A 10/1986 Nagao et al.
4,642,908 A 2/1987 Brenner
4,806,254 A 2/1989 Church
4,891,890 A 1/1990 Church
5,040,311 A 8/1991 Roy
5,234,610 A 8/1993 Gardlik et al.
5,438,773 A 8/1995 Chaffee
5,442,938 A 8/1995 Kislyuk
5,445,747 A 8/1995 Kvietok et al.
5,461,742 A 10/1995 Pasad et al.
5,463,821 A 11/1995 Gauer
5,595,071 A 1/1997 Pasad et al.
5,749,163 A 5/1998 Staub et al.
5,771,604 A 6/1998 Wunderlich et al.
5,789,368 A 8/1998 You et al.
5,810,265 A 9/1998 Cornelius et al.
5,884,418 A 3/1999 Mc Nally
5,912,408 A 6/1999 Trinh et al.
5,930,909 A 8/1999 Mc Nally
5,945,111 A 8/1999 Esser
5,965,517 A 10/1999 Mooney
5,966,831 A 10/1999 Anderson
5,968,404 A 10/1999 Trinh et al.
5,980,583 A 11/1999 Staub et al.
5,997,759 A 12/1999 Trinh et al.
6,001,343 A 12/1999 Trinh et al.
6,067,723 A 5/2000 Lafrenz
6,103,678 A 8/2000 Masschelein et al.
6,160,110 A 12/2000 Thomaides et al.
6,277,810 B2 8/2001 Baines et al.
6,279,834 B1 8/2001 Fox et al.
6,315,800 B1 11/2001 Gomes et al.
6,376,455 B1 4/2002 Friedi et al.
6,474,563 B2 11/2002 Pletcher et al.
6,491,840 B1 12/2002 Frankenbach et al.
6,503,413 B2 1/2003 Uchiyama et al.
6,571,993 B2 6/2003 Rodd et al.
6,574,883 B2 6/2003 Giblin et al.
6,604,297 B2 8/2003 Hagemann et al.
6,609,311 B2 8/2003 Hagemann et al.
6,696,405 B2 2/2004 Mooney
6,792,695 B2 9/2004 Fry et al.
6,883,723 B2 4/2005 Griese et al.
6,889,399 B2 5/2005 Steiner et al.
7,021,087 B2 * 4/2006 France et al. ..... 68/17 R
7,059,065 B2 6/2006 Gerlach et al.
7,146,749 B2 12/2006 Barron et al.
2001/0036909 A1 11/2001 Levinson
2001/0044399 A1 11/2001 Keppie et al.
2001/0052551 A1 12/2001 Pletcher et al.
2001/0052552 A1 12/2001 Hamaguchi et al.
2002/0050073 A1 5/2002 Hagemann et al.
2002/0069465 A1 6/2002 Chute et al.
2002/0078589 A1 6/2002 Hagemann et al.
2002/0083615 A1 7/2002 Giblin et al.
2002/0088502 A1 7/2002 Van Rompuy et al.
2002/0100122 A1 8/2002 Rodrigues et al.
2002/0112293 A1 8/2002 Trinh et al.
2003/0035748 A1 2/2003 Trinh et al.
2003/0196348 A1 10/2003 Hagemann et al.
2003/0199416 A1 10/2003 Fry et al.
2003/0199417 A1 10/2003 Fry et al.
2003/0200674 A1 10/2003 Fry et al.
2003/0213145 A1 11/2003 Hagemann et al.
2003/0224965 A1 12/2003 Conley et al.
2004/0064970 A1 4/2004 Hagemann et al.
2004/0118014 A1 6/2004 Burgess et al.
2004/0123489 A1 7/2004 Pancheri et al.
2004/0123490 A1 7/2004 Pancheri et al.
2004/0134090 A1 7/2004 Heilman et al.
2004/0134094 A1 7/2004 Hahn et al.
2004/0221476 A1 11/2004 Jones et al.
2004/0253376 A1 12/2004 Parker
2004/0259750 A1 12/2004 DuVal et al.
2005/0020478 A1 1/2005 Cooke et al.
2005/0022311 A1 2/2005 Zhang et al.
2005/0076453 A1 4/2005 Lucas et al.
2005/0076532 A1 4/2005 Ward et al.
2005/0076533 A1 4/2005 Huston et al.
2005/0076534 A1 4/2005 Ofosu-Asante et al.
2005/0120584 A1 6/2005 DuVal et al.
2005/0251924 A1 11/2005 DuVal et al.
2006/0080860 A1 4/2006 Clark et al.
2006/0123654 A1 6/2006 Zhang et al.
2006/0162180 A1 7/2006 Heilman et al.
2006/0191157 A1 8/2006 Gerlach et al.
2007/0000068 A1 1/2007 France et al.
2007/0000291 A1 1/2007 France et al.

FOREIGN PATENT DOCUMENTS

EP 0 130 682 1/1985
EP 0 118 313 5/1987
EP 0 315 879 B1 5/1989
EP 0 204 484 B1 3/1992
EP 0 594 154 A1 4/1994
EP 0 848 999 A2 6/1998
EP 0 676 497 B1 9/1999
EP 0 953 669 A2 11/1999
EP 1 479 757 A1 11/2004
GB 2 066 309 A 7/1981
GB 2 231 944 A 11/1990
GB 2 354 006 B 3/2001
GB 2 366 568 A 3/2002
GB 2 346 678 B 10/2002
JP 02-302300 12/1990
JP 06-015090 1/1994
JP 1995068094 A2 3/1995
JP 08-150293 6/1996
JP 1996215488 A 8/1996

| | | | |
|---|---|---|---|
| JP | 09-267000 | A | 10/1997 |
| JP | 10-290898 | A | 11/1998 |
| JP | 2002069832 | A2 | 3/2002 |
| JP | 2002115182 | A | 4/2002 |
| WO | WO 96/09430 | | 3/1996 |
| WO | WO 99/55952 | A1 | 11/1999 |
| WO | WO 99/55953 | A1 | 11/1999 |
| WO | WO 00/01421 | A1 | 1/2000 |
| WO | WO 00/01422 | A1 | 1/2000 |
| WO | WO 00/01493 | A1 | 1/2000 |
| WO | WO 00/11133 | | 3/2000 |
| WO | WO 00/24851 | A2 | 5/2000 |
| WO | WO 00/24856 | A1 | 5/2000 |
| WO | WO 00/24858 | A1 | 5/2000 |
| WO | WO 00/38512 | A1 | 7/2000 |
| WO | WO 00/55292 | | 9/2000 |
| WO | WO 00/58428 | | 10/2000 |
| WO | WO 01/07710 | A1 | 2/2001 |
| WO | WO 01/18145 | A2 | 3/2001 |
| WO | WO 01/66264 | A1 | 9/2001 |
| WO | WO 02/08510 | A1 | 1/2002 |
| WO | WO 01/12423 | A2 | 2/2002 |
| WO | WO 02/33161 | A1 | 4/2002 |
| WO | WO 02/40623 | A2 | 5/2002 |
| WO | WO 03/004170 | A1 | 1/2003 |
| WO | WO 03/008528 | A1 | 1/2003 |
| WO | WO 03/087286 | A1 | 10/2003 |
| WO | WO 03/087461 | A1 | 10/2003 |
| WO | WO 03/102289 | A1 | 12/2003 |
| WO | WO 2004/099489 | A2 | 11/2004 |

OTHER PUBLICATIONS

U.S. Appl. No. 10/762,152, filed Jan. 21, 2004, DuVal et al.

International Critical Tables of Numerical Data, Physics, Chemistry and Technology, National Research Council of the United States of America, Edward W. Washburn, editor in chief, first electronic edition, published by Knovel, Norwich, New York, 2003, pp. 148-162.

Handbook of Chemistry and Physics, 3rd electronic edition, following the 81st printed edition, David R. Lide, editor-in-chief, published by CRC Press, Inc. 2000, Boca Raton, Florida, pp. 5-102 to 5-103, 5-4 to 5-88.

Perry's Chemical Engineer's Handbook, seventh edition, following the 81st printed edition, published by McGraw-Hill, ISBN 0-07-049841-5, 1997, pp. 2-187 to 2-195.

Brokaw, Leslie—"Get a Whiff Of This", Inc.com Magazine, Nov. 1998, (1 page) Copyright 2003 Gruner + Jahr USA Publishing, Inc. com, 77 North Washington Street, Boston, MA 02114.

StainsFile—"Classification of Dyes"; "Basic Dyes"; "Direct Dyes"; "Acid Dyes"; Comparison of Dye Structure; "Structure and Colour in Dyes"; (16 pages). Internet Website http://members.pgonline.com/~bryand/StainsFile/dyes/class/dyeclass.htm, Nov. 2002.

Innovative Packaging Network—"Clean-Clic® " (1 page). Internet Website www.ipneurope.com/Componentright1.html.

Medlin, Jennifer—"Microban, Germ Warfare", Environmental Health Perspectives v. 105, n. 3, Mar. 97 (5 pages). Internet Website www.mindfully.org/Plastic/Microban-Germ-Warfare.htm.

Exair-Newsletter—Winter Mar. 2002 (2 pages). Exair Corporation, 1250 Century Circle North, Cincinnati, Ohio, 45246-3309.

Fyffe, Matt—Technical Report—"Recent Developments in Long-Range Static Elimination", Jun. 2003 (3 pages). Meech Static Eliminators, USA, Richfield, Ohio, Internet Website www.meech.com.

Quantum Research Group "Capacitance Explained" printed Nov. 18, 2004 (3 pages). Internet Website www.qprox.com/background/capacitance.php.

Innovative Packaging Network—"Clean-Clic® " (1 page). Internet Website www.ipneurope.com/Componentright1.html, prior to Nov. 3, 2006.

Medlin, Jennifer—"Microban, Germ Warfare", Environmental Health Perspectives v. 105, n. 3, Mar. 97 (5 pages). Internet Website www.mindfully.org/Plastic/Microban-Germ-Warfare.htm, prior to Nov. 3, 2006.

* cited by examiner

FABRIC ARTICLE TREATING APPARATUS WITH SAFETY DEVICE AND CONTROLLER

CROSS REFERENCE TO RELATED APPLICATIONS

This application is a divisional of U.S. application Ser. No. 10/697,735, filed Oct. 29, 2003; which is a continuation-in-part of U.S. Ser. No. 10/418,595, filed Apr. 17, 2003; which claims the benefit of U.S. Provisional Application Ser. No. 60/374,601, filed Apr. 22, 2002; and U.S. Provisional Application Ser. No. 60/426,438, filed Nov. 14, 2002.

FIELD OF THE INVENTION

The present invention relates generally to fabric article drying appliances (a non-limiting example of which includes clothes drying equipment) and is directed to an apparatus of the type which dispenses a "benefit composition" through a nozzle that directs the benefit composition as droplets or particles into a chamber (e.g., a moving or stationery drum) of the fabric article drying appliance. The invention is additionally disclosed as a system that sprays droplets or particles that provide benefits to the fabric articles within the fabric article drying appliance, in which the system includes one or more safety features, and/or the system includes beneficial control concepts that enhance the effects of the benefit composition being dispensed through the nozzle. An optional door or lid "open" detector is provided, which can cause the benefit composition to stop spraying, and also can disconnect electrical power to a high voltage power supply that may be included when the system uses electrostatic spray droplets. An optional motion detector is provided, which in embodiments utilizing a dryer can determine whether the movable drum of the dryer is actually in motion, and thus can prevent the benefit composition from being sprayed merely by (perhaps inadvertently) pressing a start, or ON-OFF button. Another optional feature is a split-spray cycle, in which a first spraying event starts and ends, followed by some elapsed time during which no benefit composition is dispensed, then followed by at least a second spraying event. Such a second (or a third) spraying event can be controlled to "wait" for a predetermined condition, if desired, such as a threshold of relative humidity in the fabric article drying appliance, a threshold of temperature within the fabric article drying appliance, the cool-down cycle of the fabric article drying appliance, etc. The second (or further) spraying event can run at a different charging voltage for the electrostatic spray, if desired, or it can add a perfume or other beneficial compound into the interior of the fabric article drying appliance. The invention can be provided as a stand-alone (or "discrete") unit that may attach to the inner and/or outer surface(s) of a closure structure (e.g., a door, a lid, a hatch, or the like) of the fabric article drying appliance and/or household surfaces (e.g. a wall or a countertop), which operates without any interplay with the fabric article drying appliance normal control system. The invention can also be provided as part of an integrated drying apparatus control system, in which the features of the present invention are fully incorporated into the remaining portions of the controller for the drying apparatus, or perhaps the invention can be provided as a partially-integrated control system, in which the conventional or "standard" dryer apparatus control system has an interface cable or connector that communicates with the control device of the present invention. The control system of the present invention includes an optional feature that can vary the power provided to a pump or motor, as the battery voltage begins to fail in the stand-alone unit, to compensate for lower voltage. The control system of the present invention may also include an optional feature that can vary the charging voltage applied to the electrostatic sprayer, as the battery voltage begins to fail in the stand-alone unit, to compensate for lower voltage.

BACKGROUND OF THE INVENTION

Fabric article drying appliances such as clothes dryers have been around for decades. Methods for treating fabric articles within such dryers are also known in the patent art, although these methods have been developed more recently. One conventional automatic clothes dryer that incorporates a spray dispenser which dispenses liquids into the drum of the dryer is purportedly described in U.S. Pat. No. 4,207,683.

While the patent art includes spraying devices for use in clothes dryers, these have generally been controlled by an integral controller that also controls the entire dryer. Such units can be advantageously configured with novel control concepts, and also by use of input signals provided by certain types of sensors that have not been used in the past. As such, it would be advantageous to provide a stand-alone spraying device that can be mounted to a closure structure of a fabric article drying appliance such as a dryer, and which could include certain safety features, such as a door sensor or a motion sensor, and which could include certain operational features, such as providing a split spraying cycle, or controlling a pump to operate at a substantially constant output volume when the battery voltage begins to fail, or by varying the voltage of an electrostatic nozzle for different spraying events. Such features also would generally be available in a fabric article drying appliance control system that is integrated as a single control circuit.

SUMMARY OF THE INVENTION

In one embodiment of the present invention, a stand-alone (or discrete) dispensing apparatus with a control unit is presented, in which a dispensing nozzle is mounted to the interior of a clothes dryer, while the control unit is mounted in an exterior relationship to the dryer. The control unit may be mounted to any external surface of the fabric article drying appliance, non-limiting examples of which include: the door or a lid or hatch, the side wall, the top wall, or combinations thereof. Furthermore, the dispensing nozzle is in communication with the interior of the fabric article drying appliance, and may be mounted on any interior surface of the fabric article drying appliance, non-limiting examples of which include: the door or a lid or hatch, the drum, the back wall of the interior chamber, mounted through the door, and the like. The discrete dispensing apparatus of the present invention could, optionally, be mounted as a single unit within the fabric article drying appliance within a single housing or enclosure. Moreover, the dispensing apparatus of the present invention could, optionally, be integrated into the controller of the fabric article drying appliance (for example, a clothes dryer) itself, or it could be partially integrated with the dryer's controller in a manner such that it is connected to the dryer's controller through an electrical connector or via a communications port.

It is another advantage of the present invention to provide a spraying apparatus for use in fabric article drying appliances that exhibit certain safety features, such as an additional door sensor that can terminate operation of the sprayer when the door has been opened, and also a motion sensor that can detect if a drum of a dryer is actually moving before allowing a nozzle to dispense the benefit composition of interest.

It is a further advantage of the present invention to provide a controller that operates with a fabric article drying appliance in which enhanced methodologies allow for a split spraying interval, or by varying the voltage of an electrostatic nozzle, or for effectively increasing the life of the batteries of a stand-alone unit by increasing the output of a pump as the battery voltage begins to fail.

Additional advantages and other novel features of the invention will be set forth in part in the description that follows and in part will become apparent to those skilled in the art upon examination of the following or may be learned with the practice of the invention.

To achieve the foregoing and other advantages, and in accordance with one aspect of the present invention, a fabric article treating system used in a fabric article drying appliance is provided, which comprises: a fabric article drying appliance having a chamber and a closure structure, the closure structure having a closed position and at least one open position, the closure structure allowing access to the chamber; a source of benefit composition; a nozzle in communication with the chamber; a dispensing apparatus that compels benefit composition from the source of benefit composition toward the nozzle, thereby spraying the benefit composition into the chamber; a closure structure sensor; and a control circuit that initiates spraying of the benefit composition, wherein the control circuit prevents the benefit composition from being sprayed when the closure structure sensor indicates that the closure structure is not in the closed position.

In accordance with another aspect of the present invention, a fabric article treating system used in a fabric article drying appliance is provided, which comprises: a fabric article drying appliance having a movable chamber and a closure structure, the closure structure having a closed position and at least one open position, the closure structure allowing access to the movable chamber, the movable chamber being placed into motion during operation; a source of benefit composition; a nozzle in communication with the movable chamber; a dispensing apparatus that compels benefit composition from the source of benefit composition to the nozzle, thereby spraying the benefit composition into the movable chamber; a motion sensor; and a control circuit that initiates spraying of the benefit composition, wherein the control circuit prevents the benefit composition from being sprayed when the motion sensor indicates that the movable chamber is not in motion.

In accordance with yet another aspect of the present invention, a fabric article treating system used in a fabric article drying appliance is provided, which comprises: a fabric article drying appliance having a chamber and a closure structure, the closure structure having a closed position and at least one open position, the closure structure allowing access to the chamber; a source of benefit composition; a nozzle in communication with the chamber; a dispensing apparatus that compels benefit composition from the source of benefit composition toward the nozzle, thereby spraying the benefit composition into the chamber; and a control circuit that is configured: (a) to spray the benefit composition through the nozzle upon commencement of a spraying event; and (b) to initiate a first spraying interval of the spraying event and a second spraying interval of the spraying event, such that the first spraying interval and the second spraying interval are separated in time.

In accordance with still another aspect of the present invention, a fabric article treating system used in a fabric article drying appliance is provided, which comprises: a fabric article drying appliance having a chamber and a closure structure, the closure structure having a closed position and at least one open position, the closure structure allowing access to the chamber; a benefit composition reservoir; a nozzle in communication with the chamber; a pump apparatus that compels benefit composition from the benefit composition reservoir toward the nozzle, thereby spraying the benefit composition into the chamber; an electric motor that actuates the pump apparatus; a battery; a voltage sensing circuit that determines an output voltage produced by the battery; and a control circuit that is configured: (a) to spray the benefit composition through the nozzle upon commencement of a spraying event; (b) to generate a pulse-width modulated variable output signal that controls the electric motor; and (c) to increase a duty cycle of the pulse-width modulated variable output signal as the battery-produced output voltage decreases, thereby causing the pump apparatus to provide a substantially constant volume of the benefit composition to the nozzle even though the battery has become partially discharged such that it cannot maintain its rated output voltage.

In accordance with a further aspect of the present invention, a fabric article treating apparatus is provided, which comprises: a source of benefit composition; a nozzle in communication with the source of benefit composition; a dispensing apparatus that compels the benefit composition from the source of benefit composition toward the nozzle, thereby spraying the benefit composition; at least one safety sensor; and a control circuit that initiates spraying of the benefit composition, wherein the control circuit prevents the benefit composition from being sprayed when the at least one safety sensor indicates that a predetermined condition exists.

Still other advantages of the present invention will become apparent to those skilled in this art from the following description and drawings wherein there is described and shown a preferred embodiment of this invention in one of the best modes contemplated for carrying out the invention. As will be realized, the invention is capable of other different embodiments, and its several details are capable of modification in various, obvious aspects all without departing from the invention. Accordingly, the drawings and descriptions will be regarded as illustrative in nature and not as restrictive.

BRIEF DESCRIPTION OF THE DRAWINGS

The accompanying drawings incorporated in and forming a part of the specification illustrate several aspects of the present invention, and together with the description and claims serve to explain the principles of the invention. In the drawings:

DEFINITIONS

The phrase "fabric article treating system" as used herein means a fabric article drying appliance, a non-limiting example of which includes a conventional clothes dryers and/or modifications thereof. The fabric article treating system also includes a fabric article treating apparatus which may be discrete in relation to the fabric article drying appliance and/or it may be integrated into the fabric article drying appliance. Furthermore, the fabric article treating apparatus may be integrated into a readily replaceable portion of the fabric article drying appliance, a non-limiting example of which includes a closure structure of the drying appliance.

"Fabric article" (or "fabric") as used herein means any article that is customarily cleaned in a conventional laundry process or in a dry cleaning process. The term encompasses articles of fabric including but not limited to: clothing, linen, draperies, clothing accessories, leather, floor coverings, sheets, towels, rags, canvas, polymer structures, and the like. The term also encompasses other items made in whole or in part of fabric material, such as tote bags, furniture covers, tarpaulins, shoes, and the like.

The phrase "critical moisture content" as used herein, relates to the moisture content of the air within the clothes drying appliance, the moisture content of one or more fabric articles, and combinations thereof.

DETAILED DESCRIPTION OF THE INVENTION

Reference will now be made in detail to the embodiments of the invention, examples of which are illustrated in the accompanying drawings, wherein like numerals indicate the same elements throughout the views.

Figure 1:
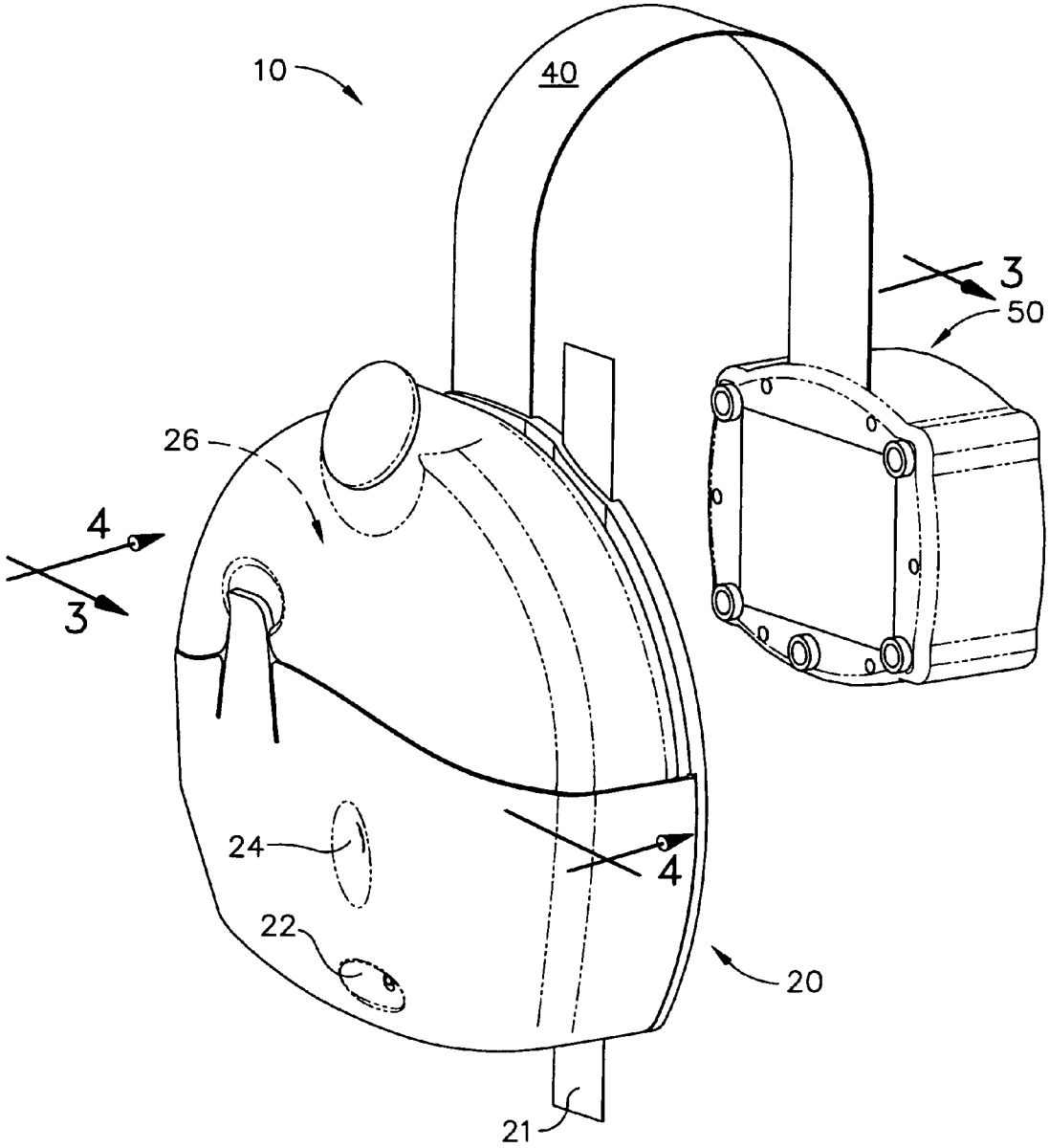
FIG. 1 is a perspective view of an embodiment for a stand-alone fabric article treating apparatus that is constructed according to the principles of the present invention.

Referring now to the embodiment of FIG. 1, a "stand-alone" controller and dispenser unit (i.e., as a self-contained device), generally designated by the reference numeral 10, is illustrated as having two major enclosures (or housings) 20 and 50. In this embodiment, the enclosure 20 acts as an "inner housing" which is located in the interior of a fabric article drying appliance, while the enclosure 50 acts as an "outer housing" that is located in the exterior of the fabric article drying appliance. The enclosure 50 may be mounted on the exterior surface of the fabric article drying appliance door, however, it may instead be mounted on any exterior surface, non-limiting examples of which include: the side walls, the top walls, the outer surface of a top-opening lid, and the like, including a wall or other household structure that is separate from the fabric article drying appliance. Furthermore, the enclosure 20 may be mounted on any interior surface of the fabric article drying appliance, examples of which include, but are not limited to: the interior surface of the door, the drum of the fabric article drying appliance, the back wall, the inner surface of a top-opening lid, and the like.

Figure 8:
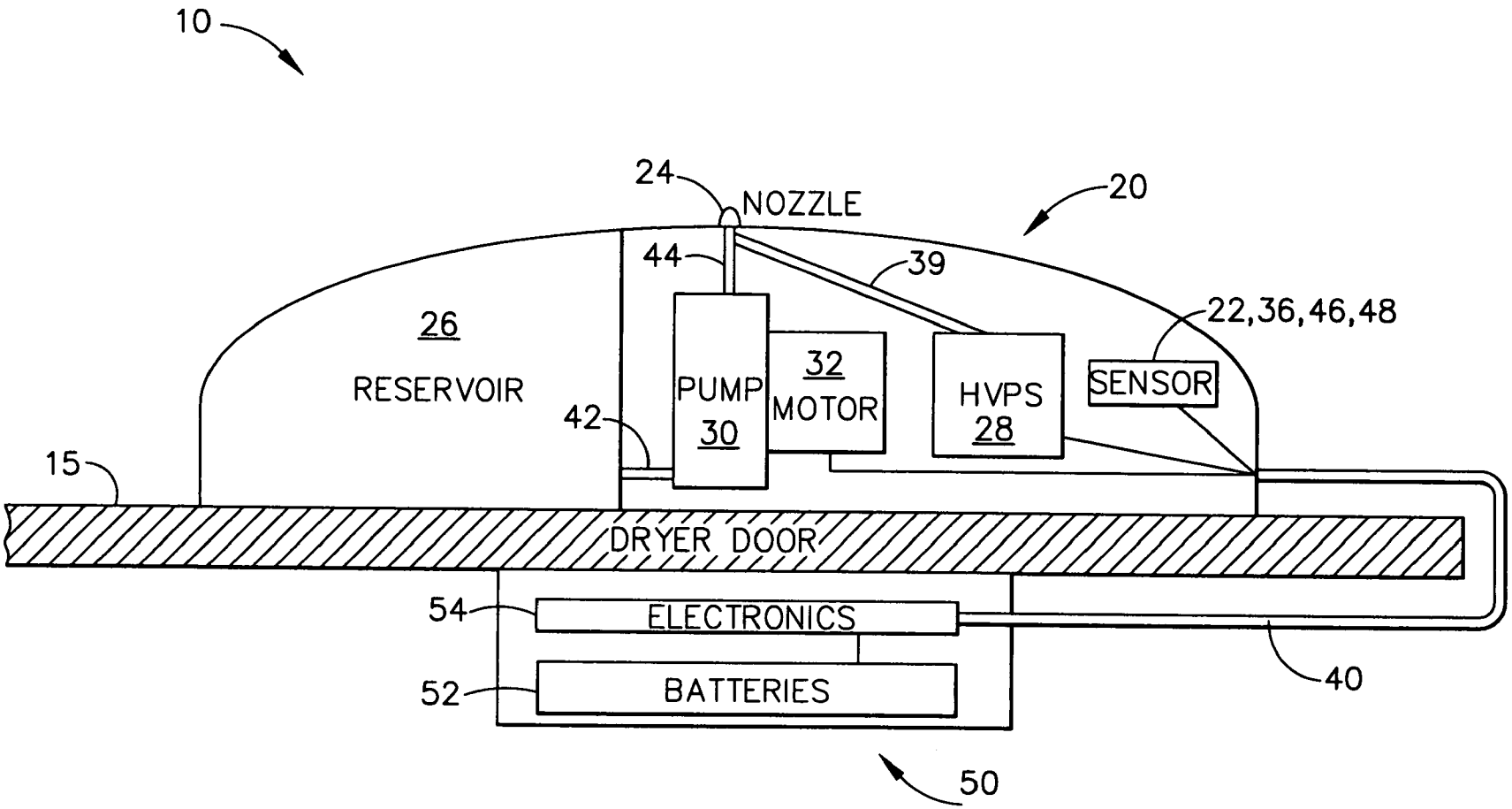
FIG. 8 is a diagrammatic view in partial cross-section of the fabric article treating apparatus of FIG. 1, as it is mounted to the door of a clothes dryer apparatus.

Enclosure 50 may be permanently mounted to the exterior surface, or preferably releasably attached to the exterior surface. Likewise, enclosure 20 may be permanently mounted to the interior surface, or releasably attached to the interior surface. One configuration for such an attachment is illustrated in FIG. 8, in which the door of the drying appliance is generally designated by the reference numeral 15.

When mounted on the interior surface of the door, for example, the enclosure 20 may be constructed so as to have the appearance of being "permanently" mounted, such that it seems to be "built into" the door of a dryer unit (or other type of fabric article drying appliance), without it actually being truly constructed as part of the fabric article drying appliance. On the other hand, enclosure 20 perhaps may be more loosely mounted near the door, or along side the interior surface of the door, much like one of the embodiments 10 as depicted in FIGS. 1-4 that "hangs" along a vertical door of the appliance. It will be understood that the term "door," as used herein, represents a movable closure structure that allows a person to access an interior volume of the dryer apparatus, and can be of virtually any physical form that will enable such access. The door "closure structure" could be a lid on the upper surface of the dryer apparatus, or a hatch of some sort, or the like.

It will be understood that the present invention can be readily used in other types of fabric "treating" devices, and is not limited solely to clothes "dryers." In the context of this patent document, the terms "dryer" or "drying apparatus" or "fabric article drying appliance" include devices that may or may not perform a true drying function, but may involve treating fabric without attempting to literally dry the fabric itself. As noted above, the terms "dryer" or "drying apparatus" or "fabric article drying appliance" may include a "dry cleaning" process or apparatus, which may or may not literally involve a step of drying. The term "fabric article drying appliance" as used herein, also refers to any fabric treating device that utilizes moving air directed upon one or more fabric articles, a non-limiting example of which includes a clothes dryer, and modifications thereof. Such devices include both domestic and commercial drying units used in dwellings, Laundromats, hotels, and/or industrial settings, for example.

In addition to the above, it should be noted that some drying appliances include a drying chamber (or "drum") that does not literally move or rotate while the drying appliance is operating in a drying cycle. Some such dryers use moving air that passes through the drying chamber, and the chamber does not move while the drying cycle occurs. Such an example dryer has a door or other type of access cover that allows a person to insert the clothing to be dried into the chamber. In many cases, the person "hangs" the clothing on some type of upper rod within the drying chamber. Once that has been done, the door (or access cover) is closed, and the dryer can begin its drying function. A spraying cycle can take place within such a unit, however, care should be taken to ensure that the benefit composition becomes well dispersed within the drying chamber, so that certain fabric items do not receive a very large concentration of the benefit composition while other fabric items receive very little (or none) of the benefit composition.

It should be noted that the treating apparatus 10 may be grounded by way of being in contact with a grounded part of the fabric article drying appliance such as by a spring, patch, magnet, screw, arc corona discharge, or other attaching means, and/or by way of dissipating residual charge. One non-limiting way of dissipating the charge is by using an ionizing feature, for example a set of metallic wires extending away from the source. In many instances fabric article drying appliances such as clothes dryers have an enameled surface.

One method of grounding would be to ground to the enameled surface of the fabric article drying appliance by utilizing a pin that penetrates the non-conductive enamel paint for grounding thereto. Another method of grounding to the non-conductive surface of a fabric article drying appliance comprises the usage of a thin metal plate that is positioned between the fabric article drying appliance and the fabric article treating device which serves to provide a capacitive discharge. Typical thickness of such a plate is from about 5 microns to about 5000 microns.

In FIG. 1, a discharge nozzle 24 and a "door sensor" 22 are visible on the inner housing 20, which also includes a benefit composition-holding reservoir 26 within an interior volume of the inner housing 20. The reservoir 26 may be used to hold a benefit composition. The discharge nozzle 24 can act as a fluid atomizing nozzle, using either a pressurized spray or, along with an optional high voltage power supply (not shown in FIG. 1) it can act as an electrostatic nozzle. One suitable example of a fluid atomizing nozzle is a pressure swirl atomizing nozzle made by Seaquist Dispensing of Cary, Ill. under the Model No. of DU-3813. The benefit composition can comprise a fluidic substance, such as a liquid or a gaseous compound, or it can comprise a solid compound in the form of particles, such as a powder. Reservoir 26 can be of essentially any size and shape, and could take the form, for example, of a pouch or a cartridge; or perhaps the reservoir could merely be a household water line for situations in which the benefit composition comprises potable water.

The inner housing 20 and outer housing 50 are generally (but not always) in electrical communication. In the embodiment of FIG. 1, a flat cable 40 (also sometimes referred to as a "ribbon cable") is run between the two housings 20 and 50, and travels along the inner surface of the fabric article drying appliance door 15 (see FIG. 8, for example), over the top of the door 15, and down the exterior surface of the door 15. As noted above, housings 20 and 50 may be attached to surfaces of the fabric article drying appliance other than its door 15. Housing 50 may be attached to any exterior surface including a household wall.

Figure 2:
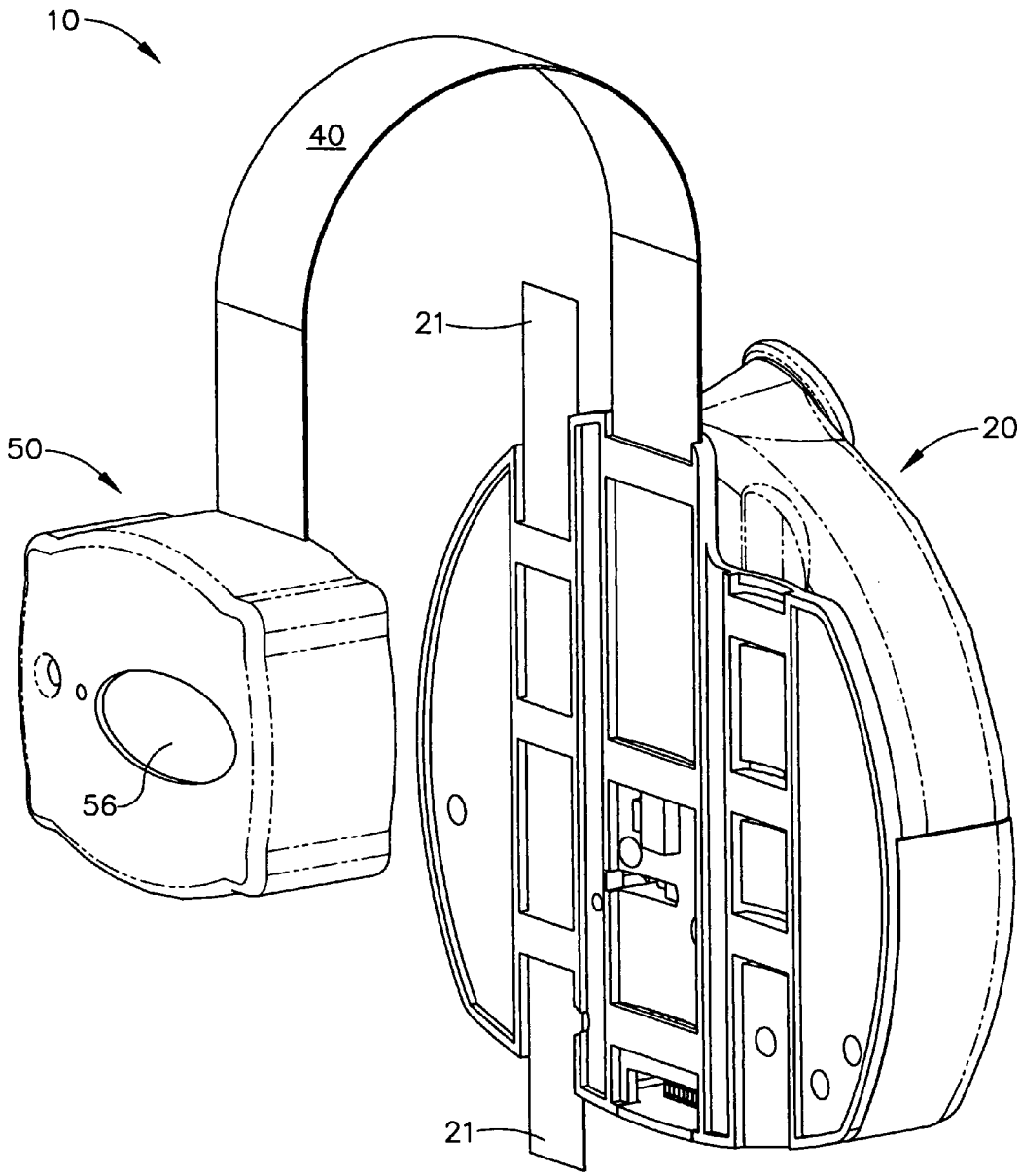
FIG. 2 is a perspective view from the opposite angle of the fabric article treating apparatus of FIG. 1.

FIG. 2 shows the same fabric article treating apparatus 10 from an opposite angle, in which the outer housing 50 is provided with an ON-OFF switch at 56. The flat cable 40 is again visible in FIG. 2, and along the surface of the inner housing 20 visible in FIG. 2, a door mounting strap 21 is visible. An end of the mounting strap is also visible in FIG. 1. Certainly other arrangements for attaching the inner housing 20 to a dryer door 15 (or other interior surface) could be arranged without departing from the principles of the present invention.

Figure 3:
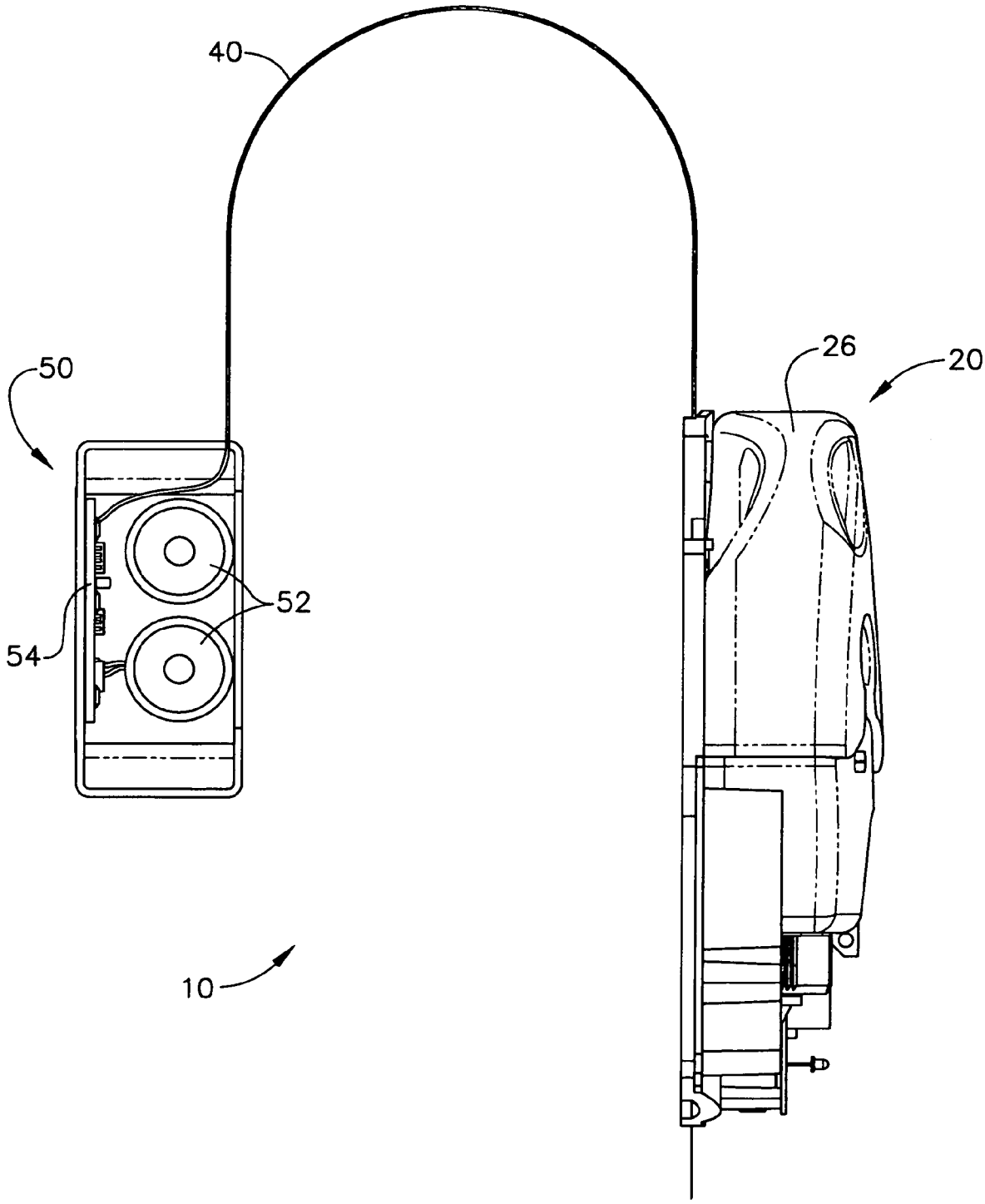
FIG. 3 is an elevational view from one end in partial cross-section of the fabric article treating apparatus of FIG. 1, illustrating the internal housing and external housing, as joined together by a flat cable.

Referring now to FIG. 3, the fabric article treating apparatus 10 is illustrated such that the reservoir 26 can be seen as an interior volume of the inner housing 20. In the outer housing 50, a set of batteries 52 can be seen, as well as a printed circuit board with electronic components at 54. The electronic components of one embodiment will be discussed below in greater detail. It will be understood that any electrical power source could be used in the present invention, including standard household line voltage, or even solar power. Batteries may be utilized if it is desired to make the apparatus 10 easily portable, however, any appropriate power adapter can be provided to convert an AC power source to the appropriate DC voltage(s) used in the electronic components on the PC board 54, or to convert a DC power source (including a battery or solar panel) to the appropriate DC voltage(s) used in the electronic components on the PC board 54.

Figure 4:
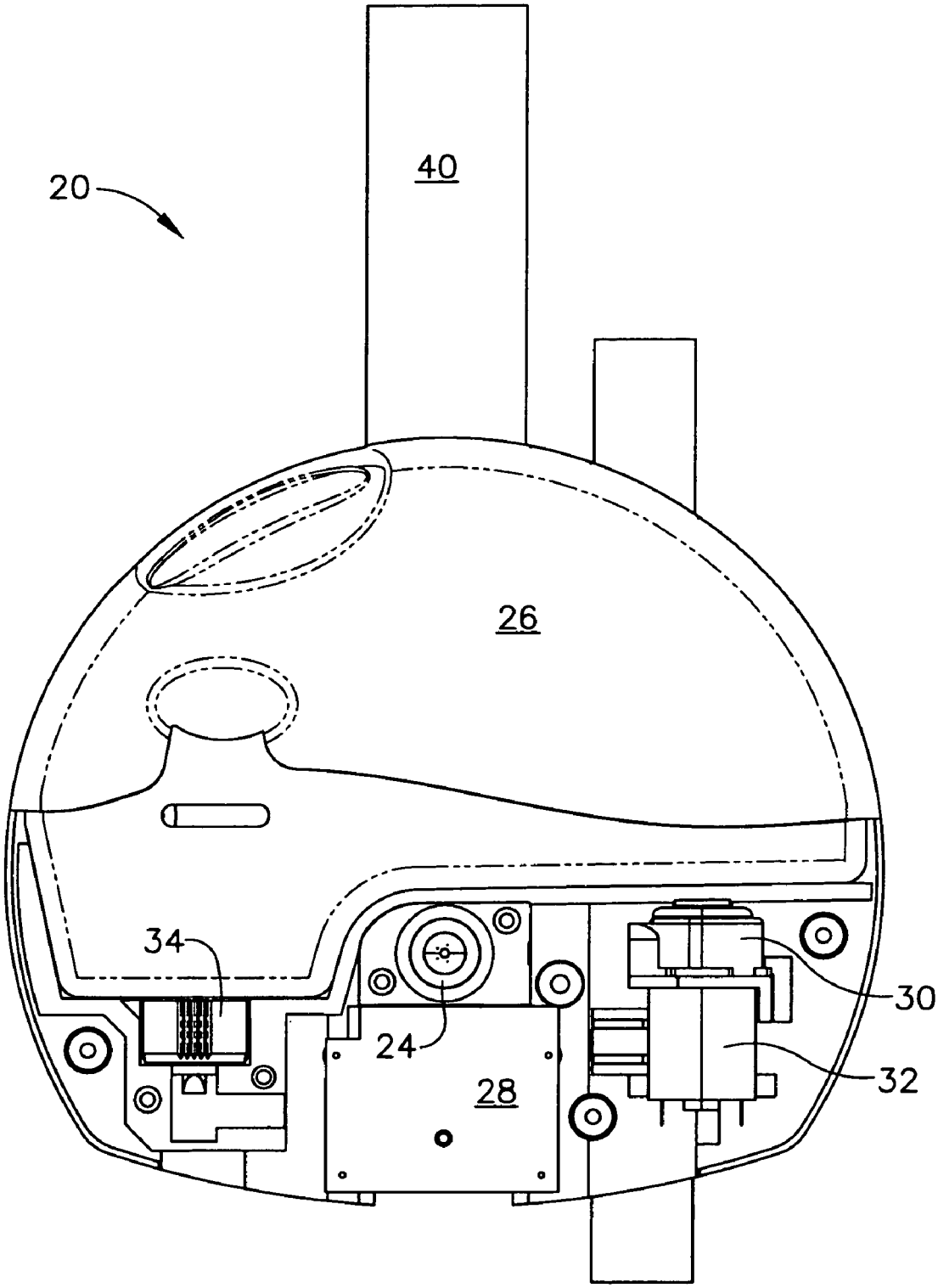
FIG. 4 is an elevational view from one side in partial cross-section of the internal housing portion of the fabric article treating apparatus of FIG. 1.

Referring now to FIG. 4, some of the other hardware devices are illustrated with respect to the inner housing 20. In the embodiment of FIG. 4, the discharge nozzle 24 acts as an electrostatic nozzle, and thereby is coupled with a high voltage power supply 28, by use of an electrical conductor not shown in this view. A quick disconnect switch 34 is included for safety purposes, so that the high voltage power supply 28 can be quickly shut down if necessary. A pump 30 and a corresponding electric motor 32 are visible in FIG. 4. Some type of pumping apparatus is used regardless as to whether the discharge nozzle 24 is producing a pressurized spray only, or an electrostatic spray that utilizes a high voltage power supply 28.

A commonly assigned patent application, U.S. Ser. No. 10/418,595, filed Apr. 17, 2003 and entitled "Fabric Article Treating Method and Apparatus," describes a method for treating a fabric article that uses an electrically charged composition that is dispensed through a discharge nozzle.

Figure 5:
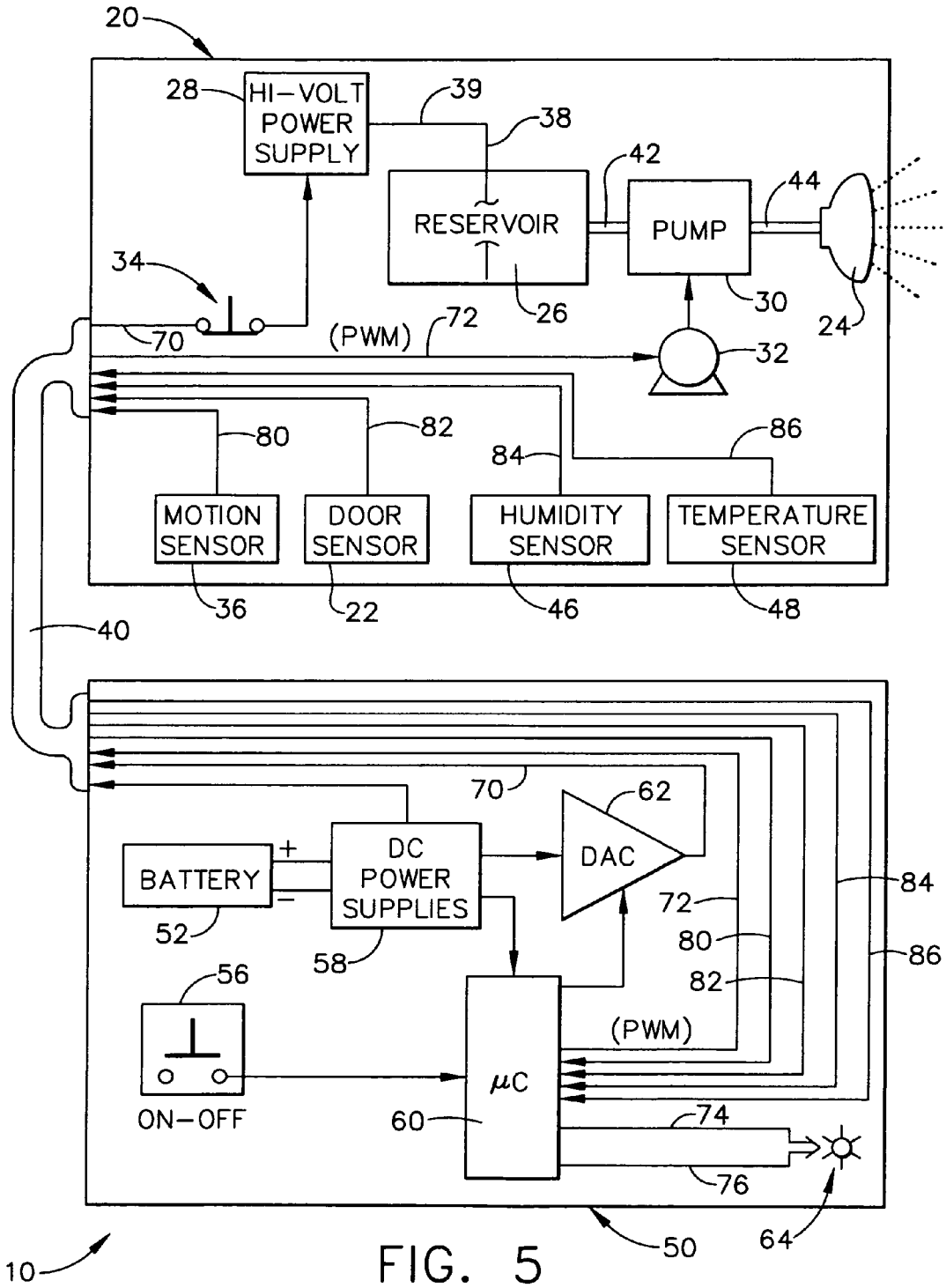
FIG. 5 is a block diagram of some of the electrical and mechanical components utilized in the fabric article treating apparatus of FIG. 1.

FIG. 5 provides a block diagram of some of the electrical and mechanical components that are included in a fabric article treating apparatus 10, as constructed according to one embodiment of the present invention.

In this example, the high voltage power supply 28 is provided in the inner housing 20, which will be used to electrically charge the fluid that will be dispensed through the discharge nozzle 24, thus making this an electrostatic nozzle system. The inner housing 20 utilizes a general body or enclosure to contain the devices needed within the drying appliance, and it will be understood that such components will generally be subjected to relatively high temperatures during the treatment cycle of the drying appliance. Consequently, the more sensitive electronic components will generally (but not always) be mounted in a different location, such as in the outer housing 50.

The flat cable 40 will bring certain command signals and electrical power into the inner housing 20, and will also receive electrical signals from sensors mounted in the inner housing 20 and communicate those sensor signals back to the outer housing 50. A power supply control signal follows a wire 70 through the quick disconnect switch 34 to the high voltage power supply 28. This signal can comprise a constant DC voltage, a constant AC voltage, a variable DC voltage, a variable AC voltage, or some type of pulse voltage, depending on the type of control methodology selected by the designer of the fabric article treating apparatus 10.

In one embodiment, the signal at 70 is a variable DC voltage, and as this voltage increases, the output of the high voltage power supply 28 will also increase in voltage magnitude, along a conductor 39 (e.g., a wire) that is attached to an electrode 38 that carries the high voltage to the nozzle 24, or into the reservoir 26. The voltage impressed onto the electrode 38 will then be transferred into the benefit composition. A constant output voltage DC high voltage power supply could optionally be used instead of the variable output voltage power supply 28 of the exemplary embodiment.

Once the benefit composition is charged within the reservoir 26 it will travel through a tube or channel 42 to the inlet of the pump 30, after which the composition will be pressurized and travel through the outlet of the pump along another tube (or channel) 44 to the discharge nozzle 24. For use in the present invention, the actual details of the type of tubing used, the type of pump 30, and the type of electric motor 32 that drives the pump, can be readily configured for almost any type of pressure and flow requirements. The electrical voltage and current requirements of the electric motor 32 to provide the desired pressure and flow on the outlet of the pump 30 can also be readily configured for use in the present invention.

Virtually any type of pump and electric motor combination can be utilized in some form or another to create a useful device that falls within the teachings of the present invention, or a stand-alone pump can be used (i.e., without an associated electric motor), as discussed below.

It should be noted that some types of pumps do not require separate input and output lines or tubes to be connected thereto, such as peristaltic pumps, in which the pump acts upon a continuous tube that extends through an inlet opening and continues through a discharge opening of the pump. This arrangement is particularly beneficial for use with electrostatically charged fluids or particles that are being pumped toward the discharge nozzle 24, because the tubing can electrically insulate the pump from the charged benefit composition. It should also be noted that an alternative pumping device could be used, if desired, such as a spring-actuated pumping mechanism. A non-limiting example of a suitable peristaltic pump is the 10/30 peristaltic pump, which may be readily obtained from Thomas Industries of Louisville, Ky.

The types of control signals used to control the electric motor 32 can vary according to the design requirements of the apparatus 10, and such signals will travel along an electrical conductor 72 to control motor 32, via the flat cable 40. If the motor 32 is a DC variable-speed motor, then a variable "steady" DC voltage can be applied, in which the greater the voltage magnitude, the greater the rotational speed of the motor. In one embodiment, the electrical signal traveling along conductor 72 can be a pulse-width modulated (PWM) signal, that is controlled by a microprocessor or a microcontroller. Of course, such a pulse-width modulated signal can also be controlled by discrete logic, including analog electronic components.

The fabric article treating apparatus 10 can be enhanced by use of certain sensors, examples of which include but are not limited to a door (or lid) sensor 22, a motion sensor 36, a humidity sensor 46, and/or a temperature sensor 48. One door/lid sensor 22 could be an optoelectronic device, such as an optocoupler or an optical input sensor, e.g., a phototransistor or photodiode. When the door/lid of the drying appliance is opened, then the door sensor 22 will change state, and will output a different voltage or current level along an electrical conductor 82 that leads from door sensor 22 back to the controller in the outer housing 50. This can be used as a safety device to quickly interrupt the discharge spray emanating from the nozzle 24. Such a door sensor 22 could be utilized even if the control system of FIG. 5 is integrated into the overall "conventional" control system of a drying appliance, which would normally have its own door sensor that for example shuts off the rotating drum of a dryer when the door becomes opened. In this instance, door sensor 22 can act as a back-up (or second) door sensor to the dryer's internal "original" sensor that shuts off the drum. One example which could be used as a door/lid sensor is an NPN phototransistor, part number PNA1801L, manufactured by Panasonic, of Osaka, Japan.

An alternative configuration for providing a "door" sensor is to use a pressure-sensitive conductor within the flat cable 40, and the electrical characteristics of this pressure-sensitive conductor will vary between a first condition in which the door is open, and a second condition in which the door is closed. This type of circuit can act, in essence, like a strain gauge that varies with a change in contact pressure, and a low voltage biasing current may be run through the pressure-sensitive conductor to provide an output signal that is detected by the control circuit of treating apparatus 10. Such a pressure-sensitive door sensor in cable 40 could eliminate the need for the optical-sensitive sensor, described in the preceding paragraph, or may be used to complete the operation of the aforementioned optical-sensitive sensor.

Another type of sensor that can be utilized by the treating apparatus 10 of the present invention is a motion sensor 36 that may be able to detect if the fabric article drying appliance is actually in use. This feature is advantageous for a "stand-alone" treating apparatus which operates separately from the fabric article drying appliance's controls, non-limiting examples which include those depicted in FIGS. 1-4. For example, if a person was to actuate the ON-OFF switch 56 of the treating apparatus 10, but the fabric article drying appliance itself was not in use, then it may be preferred for the nozzle 24 to be prevented from discharging any of the benefit composition. With a motion sensor 36, the treating apparatus 10 may be able to determine whether the fabric article drying appliance is actually in operation or not, especially in the case of a clothes dryer having a movable drum for its drying chamber. Such a motion sensor 36 can output an electrical signal along a conductor 80 that feeds the signal into the controller mounted in the outer housing 50.

One example of a motion sensor is a vibration and movement sensing switch manufactured by ASSEMtech Europe Ltd., of Clifton, N.J., available as Model No. CW1600-3. Another type of motion sensor that may be used in the present invention uses a light source to direct (infrared) light at a surface, and the relative motion of that surface can be detected by the intensity and/or frequency of the returning light. Such sensors can measure the actual speed of rotation, if that information is desired.

Yet another example of a motion sensor is one which detects sound waves, such as a microphone, to determine if the rotating drum of a dryer is in motion. When a dryer is not operating, the ambient sound will be at a first level (in decibels) and, when the dryer's movable drum is placed into motion, the overall sound will rise to a second level. A microphone (or some other type of audio sensor) will be able to detect these sounds and output an electrical signal that is representative of the original sounds. This electrical signal (e.g., following the conductive pathway 80 on FIG. 5) can be directed to the system controller, where it is analyzed for audio level (e.g., in decibels), and perhaps also in terms of its frequency components. In a typical installation for use with the present invention, the electrical signal will be compared to a predetermined threshold that is greater than the ambient sound level when the movable drum is not in motion, but which is less than the overall sound level when the movable drum is in motion (with the added tumbling sound of the drum).

There should be a fairly wide margin between the "moving sound level" and the "non-moving sound level," so that the system designer can select a threshold with confidence. However, an adjustable threshold could be provided, for example, if there is a possibility that the drying apparatus will be installed in a setting that may involve an abnormally-loud ambient condition, such as in a commercial laundromat. The threshold detector that makes a decision concerning the present sound level can comprise a separate voltage comparator circuit, if desired; or the electrical signal on the pathway 80 can be put through an A/D (analog-to-digital) converter and thus transformed into a binary number. Once the signal has been converted to a numeric value, the microcontroller 60 can perform any appropriate signal analysis in software, if desired. This could include both frequency and amplitude signal analysis, if necessary or desired, although a more powerful (i.e., "faster" or perhaps of higher resolution) A/D converter may be needed if a frequency analysis is to be performed.

Another circuit that could be applied to the audio signal on pathway 80 is a frequency filter. For example, a high-pass filter or a low-pass filter could be included to filter out a range of frequencies that can essentially be ignored for the purposes of determining whether or not the movable drum of the dryer is in motion. Such filters are typically inexpensive, and can comprise very few components. One advantage of a frequency filter is that it can be placed "upstream" of the processing components, including the A/D converter, and thereby eliminate noise or other unwanted audio frequency components that might otherwise negatively affect the decision to be made by the threshold comparator.

It should be noted that the audio frequencies to be detected by the motion sensor 36 (when in the form of a microphone, for example) do not necessarily need to be within the human hearing range of frequencies. For the purposes of the present invention, the term "audio frequency" may include ultrasonic (i.e., higher in frequency than a human can discern) and/or infrasonic (i.e., lower in frequency than a human can discern).

In addition to the above use of a "sound sensor" (such as a microphone), an audio sensor could also be used to detect a different type of motion in a fabric article drying appliance. As noted above, not all fabric article drying appliances include a movable chamber, such as a rotating drum. Some fabric article drying appliances merely blow air toward their "targets" (e.g., wearing apparel and the like) without any other type of mechanical movement, except for a blower or fan that propels the (sometimes warm or hot) air. An audio sensor could detect such air movement, or perhaps the noise made by the blower or fan. Moreover, an air flow switch could also detect such air movement. Thus, the term "motion detector" as used in this patent document will include air flow switches and/or microphones (and the like), which can detect whether or not a non-moving fabric article drying appliance is operating, when such fabric article drying appliance operation involves only the movement of air.

In the case of a fabric article drying appliance having a movable drum, such as a conventional dryer, motion sensor 36 provides a safety benefit in that the composition which is to be discharged through the nozzle 24 will not be permitted to actually spray out, unless the motion sensor 36 can detect actual motion of the dryer's drum. This could prevent a child, or even a somewhat careless adult, from initially pressing the "start" switch (or ON-OFF switch 56) of a stand-alone unit constructed according to the present invention, and then otherwise cause spray droplets to be ejected by the nozzle 24, solely by pressing that switch.

Of course, a motion sensor may not be needed at all if the control system for treating apparatus 10 is integrated into the rest of a "conventional" overall control circuit that comes with the fabric article drying appliance itself (or if the fabric article drying appliance is of a type in which the drying chamber does not move). Such an integrated fabric article drying appliance control system would naturally be aware as to whether or not the fabric article drying appliance is operating. However, in such an integrated control system, a motion sensor may still be desirable as a safety back-up device.

If the motion sensor 36 is one that detects sound, rather than mechanical motion, then it may be able to more quickly determine if a fabric article drying appliance such as the drum of a dryer has slowed down or stopped, once it has already started operating. This could be useful in a situation in which the "on-time" for the dryer was set by a human user to be quite short (either by design or by accident), such that the spray time of the nozzle 24 might actually be set to a longer time duration than the dryer's operating on-time. Without a motion sensor of some type, the dryer's control circuit (particularly for a stand-alone spraying system) would tend to continue spraying the benefit composition, even though the dryer's drum has stopped, or has begun to slow down. Any appropriate motion sensor could be used to prevent the continued spraying; however, the audio sensor may discern the slowing condition of the dryer's drum before a mechanical motion detector might be able to detect such a change in the operating state of the dryer.

Another sensor that could be used with the fabric article treating apparatus 10 of the present invention is a humidity sensor 46, which can be used to control the amount of spray droplets being discharged by the nozzle 24, and also could be utilized to determine the proper environmental conditions during an operational cycle that the spraying events should take place. Additionally, this humidity sensor may be used to maintain a specified humidity by controlling the dispensing of the benefit composition such that optimal de-wrinkling and/or other benefits are achieved. This will be discussed in greater detail below, but suffice to say that many different types of humidity sensors could be used in conjunction with the present invention, including variable conductivity sensors, such as a sensor manufactured by Honeywell, of Freeport, Ill., under the Model No. HIH-3610-001, although any of the HIH-3610 Series may be used.

The humidity sensor 46 will provide an output signal along an electrical conductor 84 that leads back to the controller of the outer housing 50. If the humidity sensor 46 is purely a variable conductance (or variable resistance) device, then some type of interface circuit would be necessary to provide some biasing current or biasing voltage to generate an output signal (as a current or voltage) that can be input on conductor 84 to the controller (e.g., the electronics on PC board 54—see FIG. 3).

A further sensor that could be useful in the treating apparatus 10 of the present invention is a temperature sensor 48, such as one that outputs an analog signal along the electrical conductor 86 that leads back to the controller in the outer housing 50. (It should be noted that some temperature sensors have a serial bus to carry a digital output signal, rather than outputting an analog voltage.) The temperature sensor 48 may not be necessary for many of the control features of the treating apparatus 10, however, the interior temperature of the drying appliance could be used to determine the proper environmental conditions for certain spraying events to occur, particularly if a "final" spraying event of the benefit composition in reservoir 26 is to take place during a "cool down" cycle of the drying appliance. This will be discussed in greater detail below. In addition, the temperature sensor 48 can also be used as an indicator that the drying appliance is operating properly—if the drying appliance has not warmed up to a predetermined minimum temperature, then its heating element (or burner) may not be working correctly, and it might be better if the benefit composition was not being sprayed in that circumstance.

The major components of the exterior housing 50 typically comprise the electronics 54 and the power source 52. For example, if power source 52 comprises four D-cell batteries connected in series, a +6 volt DC voltage will be provided to a set of DC power supplies generally designated by the reference numeral 58. The schematic drawings provided in FIGS. 6A-6C and 7 will show these power supplies 58 in greater detail, but for discussion purposes only, it will be presumed that more than one DC power supply voltage will be required by the control circuit in the outer housing 50. One of the DC power supply voltages provides energy for the high voltage power supply 28, via the electrical conductor 70 that runs through the flat cable 40. Another output voltage is provided to a microcontroller 60, which in the exemplary embodiment depicted in FIGS. 6A-6C, requires a +3.3 volt DC power supply. In the exemplary embodiment of FIGS. 6A-6C, a digital-to-analog converter (DAC) 62 is used, and the device provided by Analog Devices of Norwood, Mass. (Part No. AD 5301), requires a +5 volt DC power supply. All of these power supplies are provided by the "set" of DC power supplies 58.

Figure 6A:
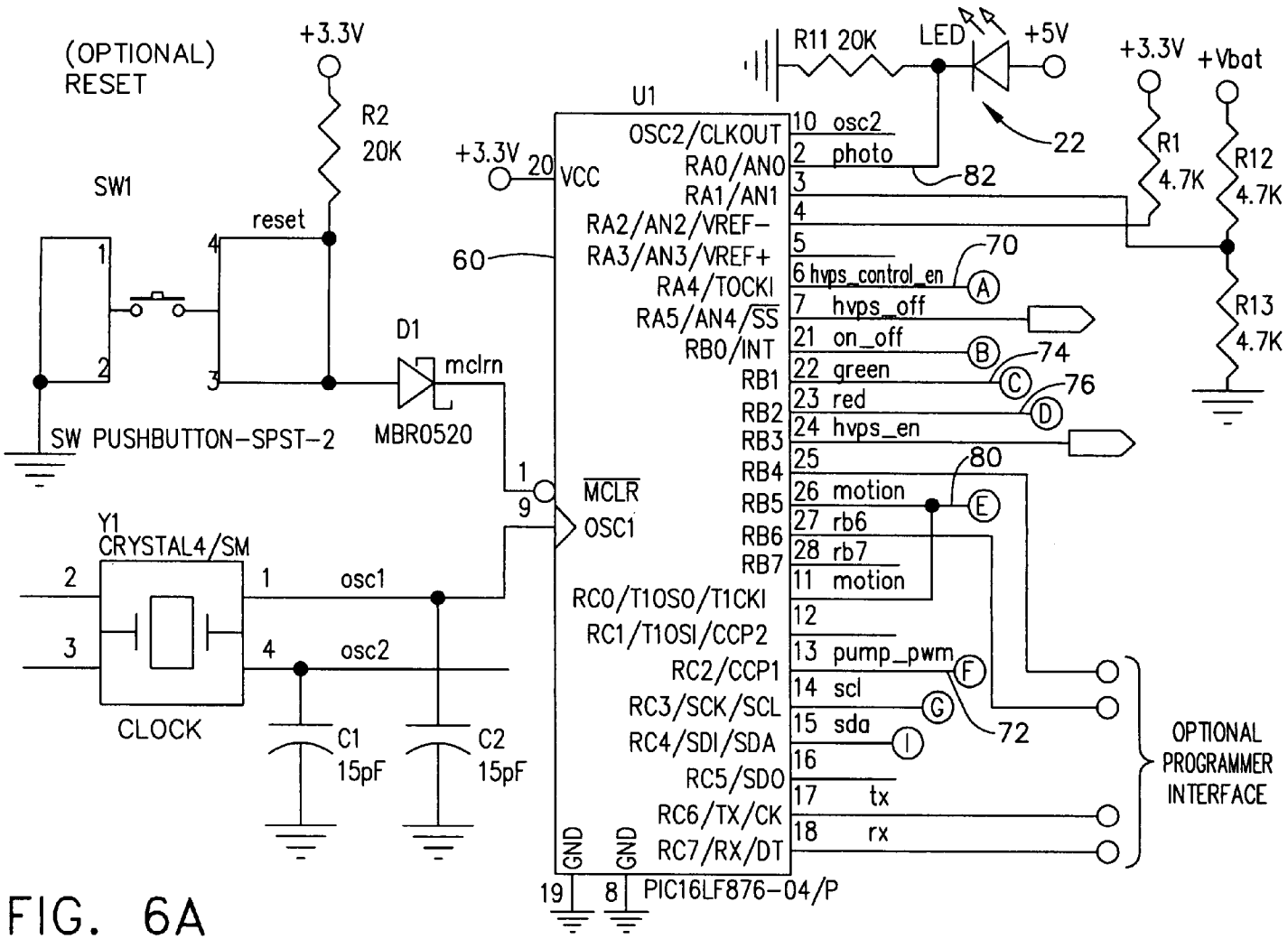
FIG. 6 (comprising FIGS. 6A, 6B, and 6C) is a schematic diagram of a first portion of the electronic controller utilized in the fabric article treating apparatus of FIG. 1.
Figure 6B:
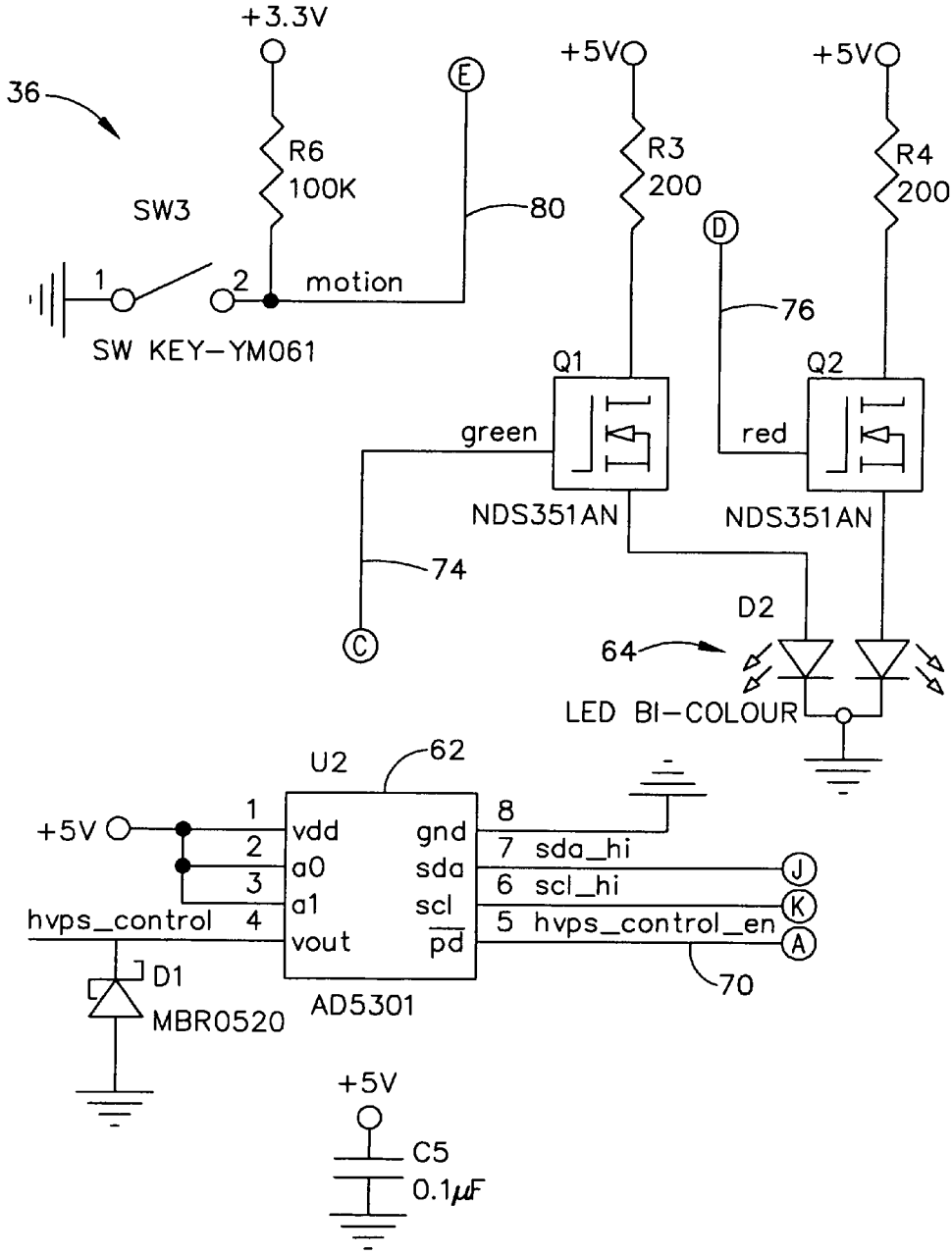
Figure 6C:
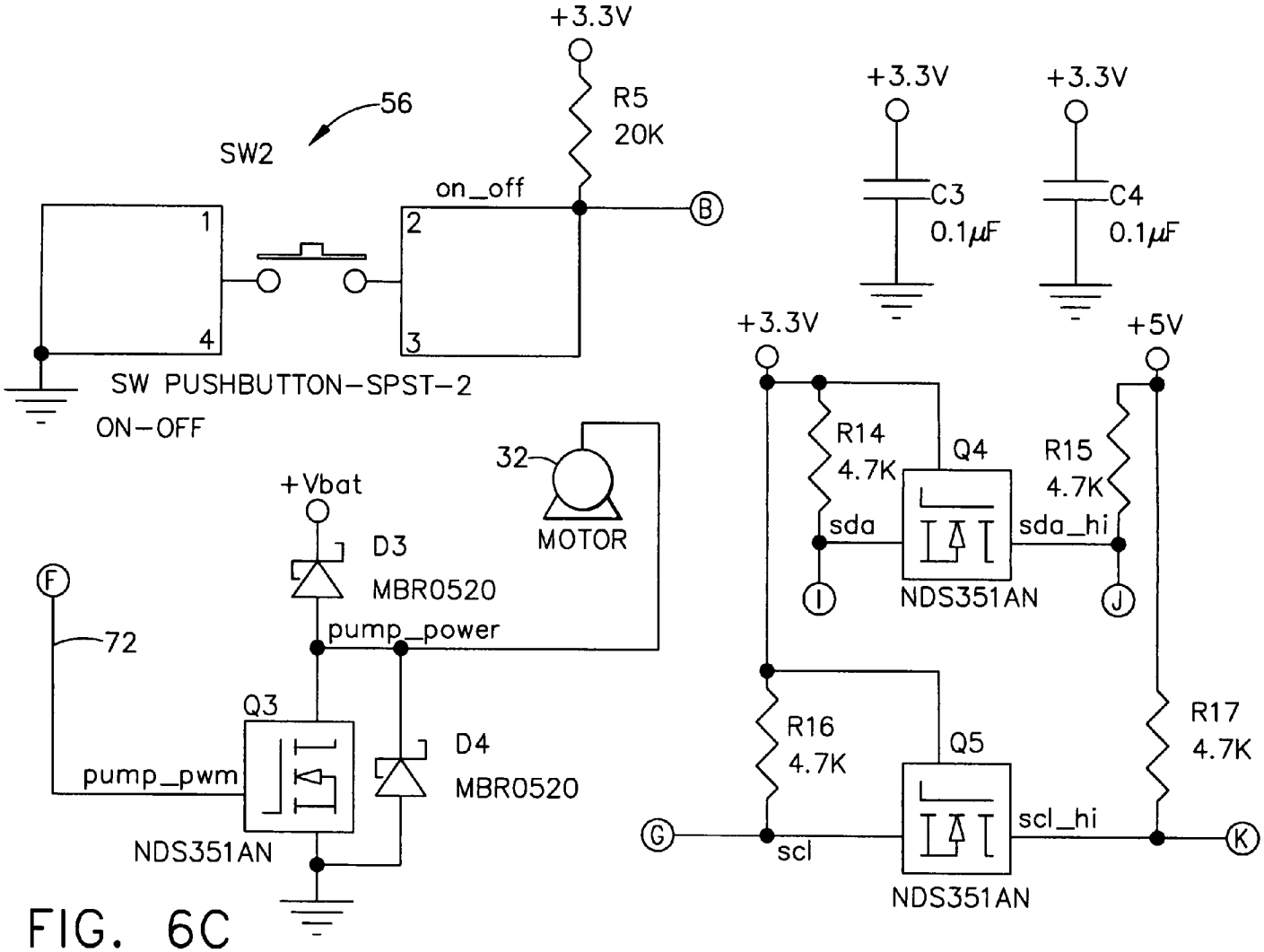

Referring now to FIGS. 6A-6C, a component which can be used for controlling the treating apparatus is a microcontroller 60. A suitable microcontroller 60 is manufactured by Microchip of Chandler, Ariz., under the Part No. PIC16LF876-04/P, but of course, other microcontrollers made by different manufacturers could easily be used. Microcontroller 60 includes on-board Random Access Memory (RAM), on-board FLASH Memory, which comprises electrically programmable non-volatile memory elements, as well as on-board input and output lines for analog and digital signals. The microcontroller 60 may also be used with a crystal clock oscillator, although an RC circuit could instead be used as a clock circuit, if desired. The clock circuit provides the timing clock pulses necessary to operate the microcontroller 60. The PIC16LF876 microcontroller also has a serial port that can be interfaced to an optional programmer interface using an RS-232 communications link.

It will be understood that the microcontroller 60 could be virtually any type of microprocessor or microcontroller circuit commercially available, either with or without on-board RAM, ROM, or digital and analog I/O, without departing from the principles of the present invention. Moreover, a sequential processor is not necessarily required to control the treating apparatus 10, but instead a parallel processor architecture could be used, or a logic state machine architecture could be used. Furthermore, the microcontroller 60 could be integrated into an Application Specific Integrated Circuit (ASIC) that could contain many other logic elements that can be used for various functions, such functions being optional depending upon the model number of the treating apparatus 10 that will be sold to a consumer. To change model number features, the manufacturer need only program the ASIC (or the on-board ROM of a microcontroller) according to the special parameters of that particular model, while using the same hardware for each of the units.

It will also be understood that discrete digital logic could be used instead of any type of microprocessor or microcontroller unit, or even analog control circuitry could be used along with voltage comparators and analog timers, to control the timing events and to make decisions based on the input levels of the various sensors that are provided with the treating apparatus 10.

FIGS. 6A-6C also includes an optional reset switch designated SWI. Such a reset switch may not be desired for a consumer apparatus. The ON-OFF switch 56 is interfaced to one of the I/O inputs to the microcontroller 60. A number of other inputs are provided to the microcontroller, including the door sensor 22, which in FIGS. 6A-6C is depicted as an optical sensor that provides a signal along the conductor 82. The motion sensor 36 outputs a signal along the conductive pathway 80 to the microcontroller 60. Other inputs not depicted on FIGS. 6A-6C could include analog inputs for the temperature and humidity sensors, respectively.

Microcontroller 60 also controls certain outputs, including a pulse-width modulated (PWM) signal along conductor 72 that drives a transistor Q3, which converts the signal to a higher voltage and greater current that drives the motor 32. Other digital outputs from the microcontroller 60 run through a voltage shifting circuit of transistors Q4 and Q5, which shifts the signals from 3.3 volt logic levels to +5 volt logic levels to control the DAC 62. Depending upon the states of these signals, the output of DAC 62 will be an analog voltage along the conductive pathway 70 that controls the high voltage DC power supply's output voltage magnitude, as discussed above. As also discussed above, this DAC 62 may not be required for full production units, particularly if it is determined that a constant DC output voltage will be preferred as supplied by the high voltage DC power supply 28 (see FIG. 7). This can be determined by the system designer.

The microcontroller 60 also outputs two control signals to a visual indicator with two LEDs of two different colors. In this example embodiment, the LEDs used are green and red. The output signal along a conductive pathway 74 drives a solid state transistor Q1, which will turn on a green LED, as desired. Another output signal along a conductive pathway 76 drives a solid state transistor Q2 that provides current to drive a red LED. Both the red and green LEDs are part of a single bi-color device, generally designated by the reference numeral 64. When desired, the green light will be displayed to the user, or the red light will be displayed. Also, both LEDs can be energized simultaneously, which will produce a yellow color discernible by a human user.

As a non-limiting example of how the bi-color LED 64 could be used, a steady green color could represent an "ON" signal for the fabric article treating apparatus 10. If the motion sensor 36 is discerning movement in the dryer that sets up a sufficient vibration to actuate the motion sensor 36 itself, then the green light could be flashing, for example. This could be a normal state for using the treating apparatus 10. During "spraying events" both the red and green LEDs could be energized, thereby showing a yellow color. This may inform the user that the spray droplets are actually being dispersed by the nozzle 24. If the door is opened, then the bi-color LED 64 could show a red color. If the battery voltage falls below a predetermined threshold, then the bi-color LED 64 could emit a flashing red light discernible by the user. These are just examples of possible indications for various operating modes. The colors of steady or flashing lights in various colors is completely up to the system designer and has much flexibility while falling within the teachings of the present invention. There are also many other methods of presenting operational information to the user, including an LCD display, or multiple individual lamps or LED's, and such alternative methodologies fall within the scope of the present invention.

Figure 7:
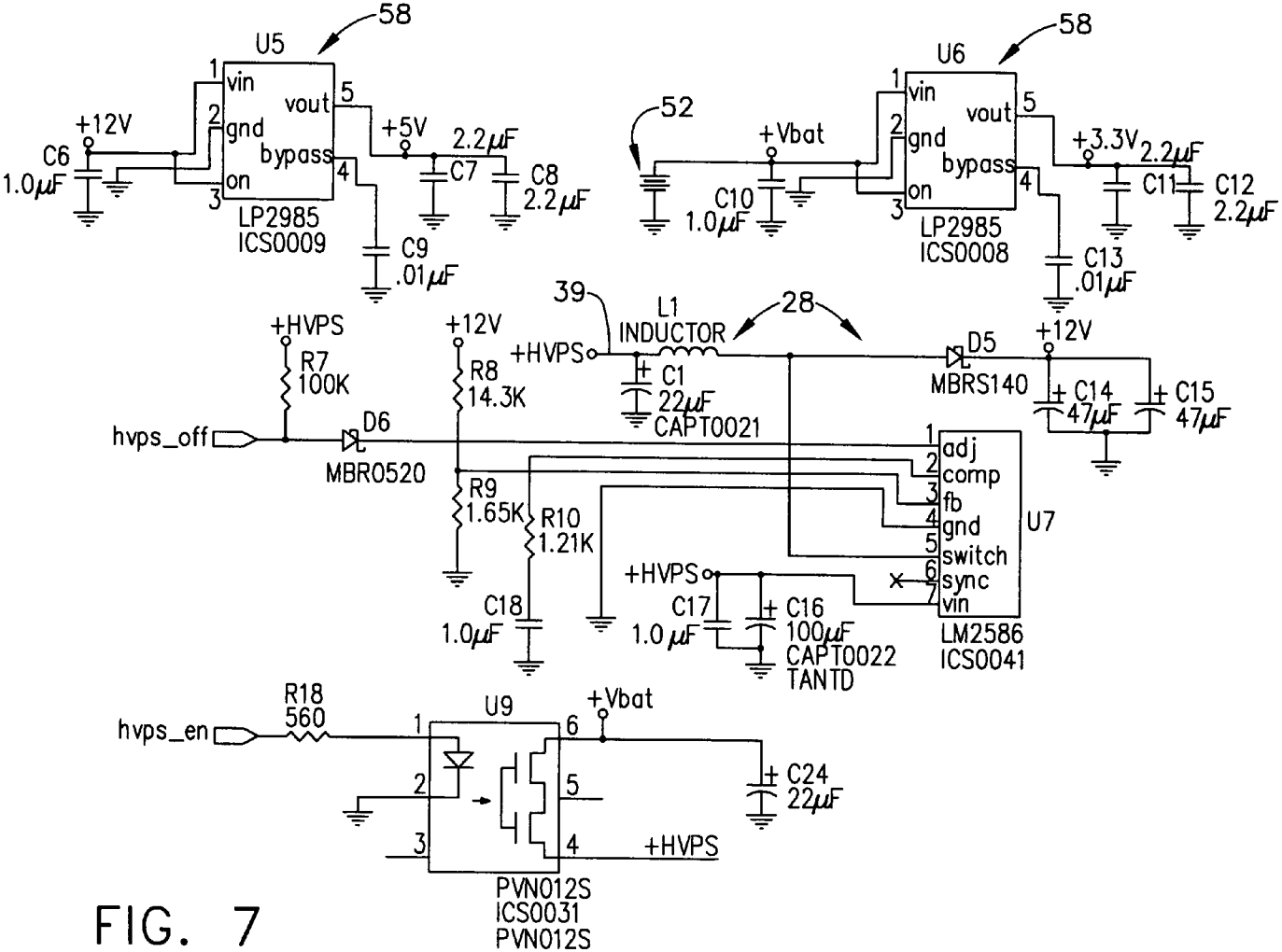
FIG. 7 is an electrical schematic diagram of other portions of the controller, including the power supply components, of the fabric article treating apparatus of FIG. 1.

Referring now to FIG. 7, the power supply circuits 58 are depicted in greater detail. The battery may be used to drive a voltage regulator U6, which outputs a +3.3 DC volt power supply rail. The regulator in this embodiment is an integrated circuit chip, Part No. LP2985 which may be obtained from National Semiconductor, of Santa Clara, Calif. Another voltage regulator chip U5 is used to provide a +5 volt rail from a +12 volt power supply voltage, which is another LP2985 regulator device (also available from National Semiconductor). FIG. 7 also depicts a boost switching regulator, which uses a +12 volt DC input power supply voltage and a switching regulator chip U7, which is an integrated circuit chip, Part No. LM2586 device, and also is available from National Semiconductor. Such voltage regulator chips are available from other semiconductor manufacturers as well. The boost regulator is generally designated by the reference numeral 28, which is referred to in the earlier figures as the high voltage power supply. The output voltage is located at the node indicated by the reference numeral 39, and this represents an electrical conductor that carries the high voltage to the electrode 38 that charges the benefit composition in the reservoir 26, or at the nozzle 24. FIG. 7 also shows a solid state relay U9 that directly provides current for the high voltage power supply rail (i.e., conductor 39) from the battery voltage.

FIG. 8 diagrammatically shows the general location of some of the components of one of the stand-alone embodiments of the fabric article treating apparatus 10 of the present invention. As discussed above, the electronics 54 and the batteries 52 are located within the outer housing 50, which is electrically connected to a flat cable 40 that carries power supply and input/output signals between the outer housing 50 and the inner housing 20.

Contained within the inner housing 20 are the reservoir 26, pump 30, electric motor 32, high voltage power supply 28, discharge nozzle 24, and various sensors that may or may not be included for a particular version of the treating apparatus 10. The electrical conductor 39 is depicted, which carries the high voltage to the nozzle 24, and this is one configuration that could be alternatively used instead of carrying the high voltage to the reservoir 26. The tubing 42 to the inlet of the pump is illustrated, as well as the tubing 44 from the outlet of the pump that provides the benefit composition to the nozzle 24. It should be noted that the high voltage power supply 28 is strictly optional within the teachings of the present invention; if spray droplets/particles emitted from the nozzle 24 are not to be electrostatically charged, then there is no need for a high voltage power supply within the inner housing 20.

Figure 9:
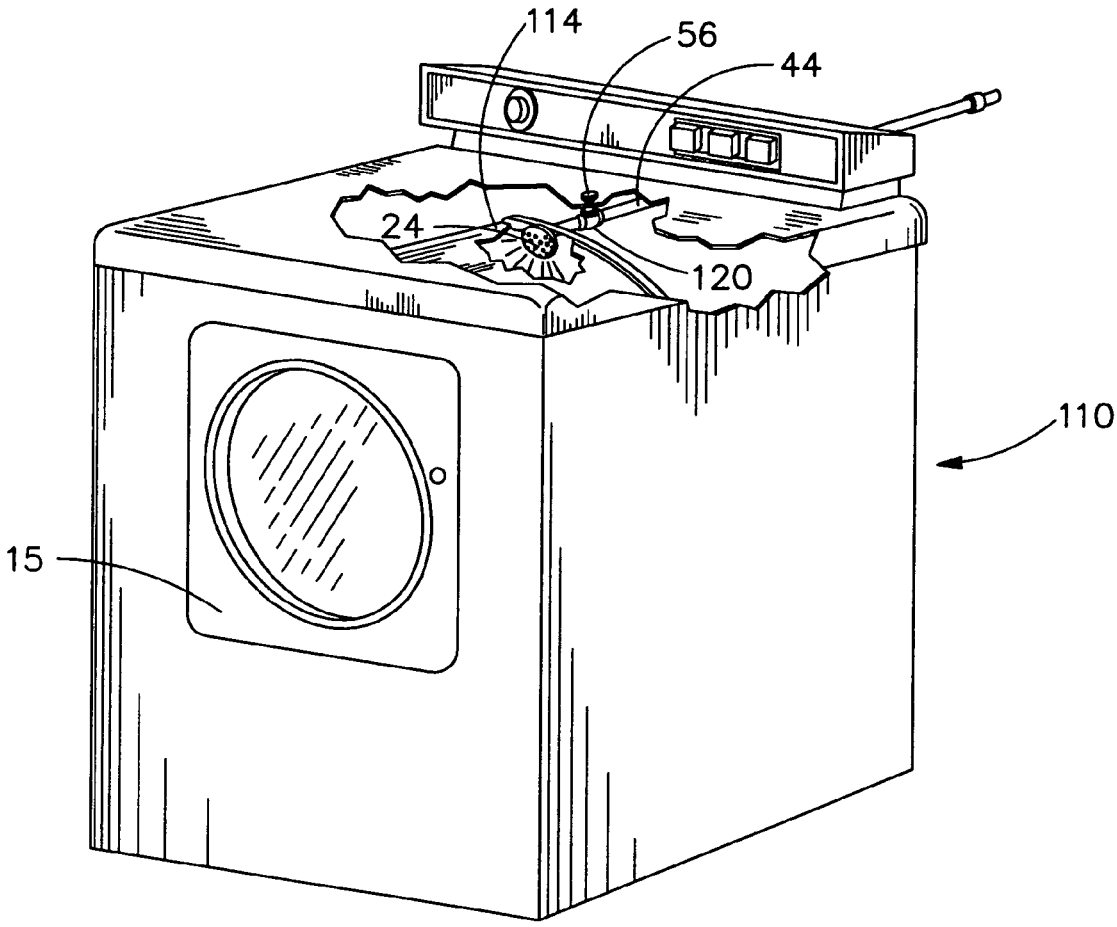
FIG. 9 is a perspective view of a fabric article drying appliance that has a nozzle which sprays a benefit composition into the drum portion of the dryer, as constructed according to the principles of the present invention.

FIG. 9 illustrates an alternative embodiment for use with the present invention, which depicts a fabric article drying appliance generally designated by the reference numeral 110. In this mode of the present invention, the controller depicted in the stand-alone embodiment of the earlier figures is now integrated into the electronic control system of the drying appliance 110. In this arrangement, a motion sensor would likely not be required, although it still could be used if certain information was desired for a particular model of the integrated electronic control system of drying appliance 110. A door 15 is illustrated in FIG. 9, which is the normal point of access by a human user to the interior drum volume of the drying appliance 110. A nozzle 24 is used to direct a benefit composition into the drum area, in which the drum is generally designated by the reference numeral 114. A supply pipe 44 brings the benefit composition to the nozzle 24, through a control valve 120, that can have an ON/OFF push button 56, if desired.

Figure 10:
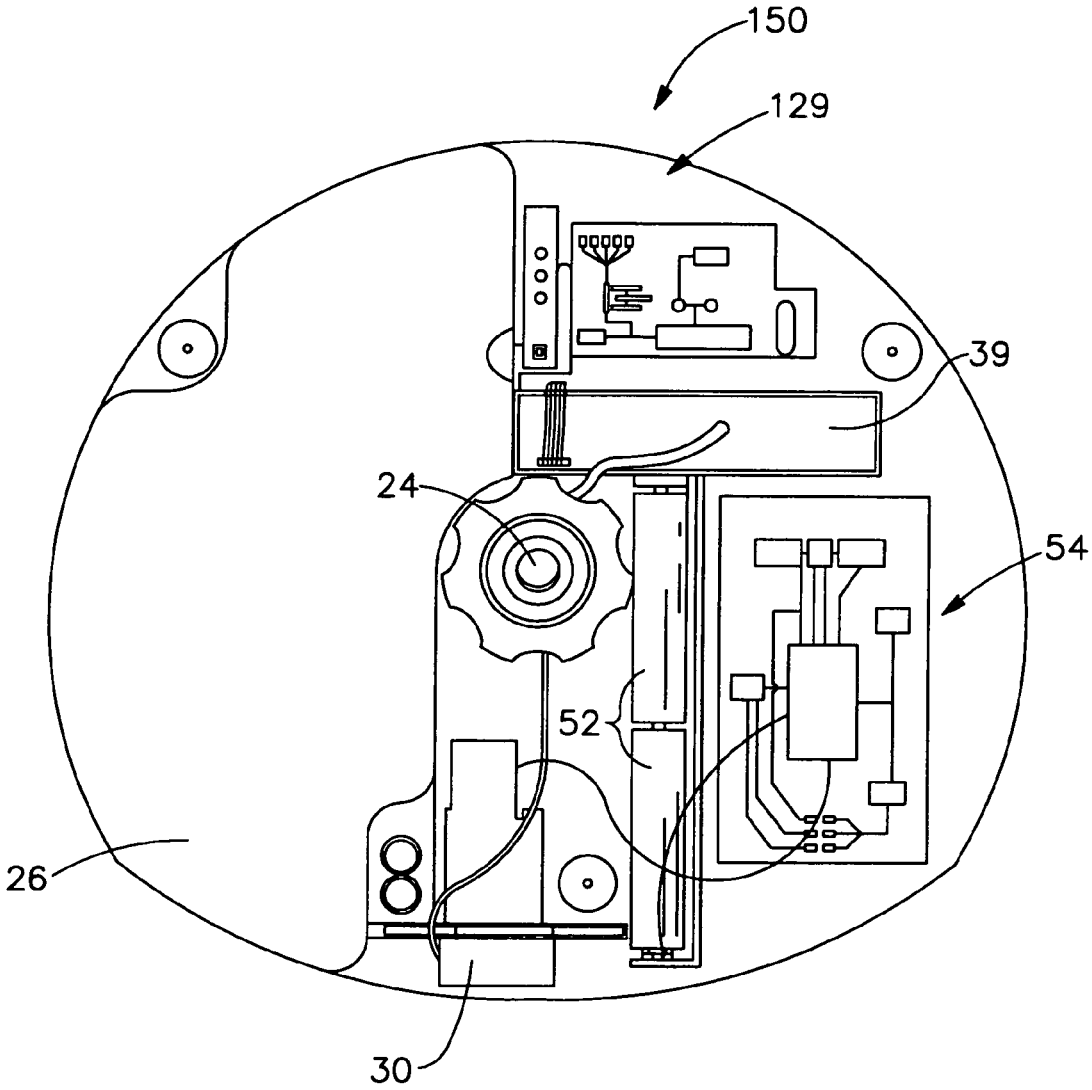
FIG. 10 is a diagrammatic view of some of the components utilized by an alternative embodiment stand-alone fabric article treating apparatus that is constructed according to the principles of the present invention, in which the entire treating apparatus is contained within a single housing or enclosure.

FIG. 10 illustrates an alternative stand-alone embodiment of the present invention, generally designated by the reference numeral 150. Components illustrated in FIG. 10 include a reservoir (or chamber) 26, an optional charging component 39 (such as an electrode or other type of electrical conductor that transports a high voltage to the reservoir or to the nozzle), a discharge nozzle 24, a pump unit 30, and a set of batteries 52. An electronic printed circuit board 54 is provided, which would typically include a microcontroller or other type of control circuit. One or more sensors are typically included in such a device, as depicted at the reference numeral 129, and could include a pressure sensor, a door sensor 22, motion sensor 36, humidity sensor 48, and/or a temperature sensor 48. In this embodiment 150, all of the components are enclosed in a single housing, and the entire unit is positioned within a fabric article drying appliance, such as a conventional clothes dryer found in a consumer's home.

It will be understood that the source of electrical energy used by the present invention may be provided in many different forms. For example, a battery (or set of batteries) can be used, such as the set of batteries 52, described above. However, standard line voltage could instead be used, such as 120 VAC, single phase power, at 60 Hz; or in Europe, the line voltage would likely be at 220 VAC at 50 Hz. For some installations, a more exotic source of electrical energy could be provided, such as a solar panel comprising photovoltaic cells or photoconductive cells.

If a pressure sensor 129 is used, it could be placed in the pathway 44 that directs benefit composition to the nozzle 24, and it then can be used to determine deleterious pressure conditions in the pathway. If the nozzle 24 becomes sufficiently clogged, for example, then a back pressure will be exhibited in this pathway 44 which is detected by the pressure sensor. If the pressure abnormally increases to a harmful level—for any reason—the pressure sensor 129 could indicate this deleterious condition (in which a line or tube might burst if action is not taken), and the controller may decide to shut down the system. A pressure switch could be utilized instead of a pressure transducer, if desired. Note that such a pressure sensor can be included in any of the embodiments of the present invention.

The "single-housing" stand-alone unit 150 of FIG. 10 can incorporate all of the electrical and electronic components that are described herein with respect to FIGS. 5-7, including any optional features, such as the high voltage power supply and certain sensors used only in particular configurations of the present invention. Unless a different type of electrical power source is provided, there would be a need for a set of batteries 52, as illustrated in FIG. 10.

There may be no need for an extended flat cable (such as flat cable 40 on FIG. 1) to carry electrical signals to and from the electronic controller on the printed circuit board 54, although some type of electrical conductors would be typically used for that purpose within the unitary device 150. However, an optional door sensor could be provided as a flat cable (or other form of cable or wire), similar to that described above in reference to the "dual housing" embodiment of FIGS. 1-4. This optional door sensor could comprise a pressure-sensitive conductor that is draped over the dryer's door, and could exhibit electrical characteristics that vary between a first condition in which the door is open, and a second condition in which the door is closed. Such a pressure-sensitive door sensor could provide a door open/closed signal, if the status of the door's position is useful to the apparatus designer.

Another optional feature of the single-housing stand-alone unit 150 is the provision for a time-delayed cycle start feature. For example, when a user wishes to begin operation of a conventional clothes dryer, the user may open the dryer's door to press the ON-OFF switch (not shown on FIG. 10), and then close the dryer's door. The electronic controller 54 can rely on the lack of motion of the dryer's drum (using a motion sensor 36) to prevent immediate spraying through the nozzle 24, or an optional timer could be added into the controller 54 that "waits" a few seconds before attempting to spray the benefit composition through the nozzle 24.

Both the fabric article treating apparatus 110 and the fabric article treating apparatus 150 may include certain safety features, such as a door sensor that can be used to interrupt a spraying event when the door of the fabric article drying appliance has been opened. Such a door sensor could also be used to interrupt electrical power to the high voltage power supply for a treating apparatus that uses an optional electrostatic nozzle. A motion sensor may also be provided as another safety feature and, as discussed above, would be advantageous for a stand-alone control unit (such as the unit 150) that might have no other methodology for determining whether the drum of the fabric article drying appliance is in motion.

Some of the other features of the present invention provide enhanced performance, such as a situation in which more than one interval of spraying is used, and in particular where a "split interval" of spraying is utilized in which a first spraying event begins and ends, then a certain amount of elapsed time occurs before the beginning of a second spraying event. In such a situation, the benefit composition to be dispensed within the clothes dryer through the nozzle 24 can be arranged such that a large majority of the composition is dispensed during the first spraying event, such as 80% of the entire amount that will be dispensed during a particular drying cycle. The remaining 20% could be sprayed later, which could actually occur near the end of the drying cycle, for example, during the cool-down cycle of the drying event (or cycle). This could be useful for a dewrinkling procedure, in which the correct amount of benefit composition at the correct dispensing rate may be critical. It will be understood that further spraying events (i.e., more than two spraying events) could be used in the drying appliance, without departing from the principles of the present invention.

One of the other parameters that might impact a dewrinkling process could be the dampness of the clothing, which could be determined by use of a humidity sensor, such as the humidity sensor 46 depicted in FIG. 5. If too much of the benefit composition is delivered to a dry fabric at a quick rate, damp spots may form on the clothing and wrinkles may be induced as the creases are set by excessive moisture and pressure from other articles of clothing. Conversely, if the benefit composition is delivered while the fabrics are still damp, or the benefit composition is delivered too slowly on dry clothing, then the benefit composition may not be able to effectively relax creases in the fabric articles. Variations in load size, types of fabric article drying appliances, fabric content, as well as humidity and temperature within the drum unit of the drying appliance, can all play a part in creating effective or ineffective dewrinkling procedures. Such variations can be effectively managed by utilizing the proper sensors, such as a humidity sensor, as well as a controller that has a capability of controlling the rate of dispensing, the initial time for a spraying event to begin, and the duration of the spraying event during which the benefit composition is dispensed to obtain optimum dewrinkling results. Furthermore, while other fabric benefits such as softening may best occur at high humidity (such that the softening actives may effectively spread on the damp fabric), other fabric benefits may be optimized at different humidity levels.

One benefit of using a humidity sensor is that such a sensor can be used to determine when the "critical moisture content" has been achieved within the fabric article drying appliance. The second spraying event could start after the relative humidity has dropped by approximately 10% below the critical moisture content. This could be detected by the humidity sensor 46. In general, the first spraying event would have terminated long before the beginning of the second spraying event in this situation. However, if the fabric article drying appliance is set to a very small load, it could be possible for the first spraying interval to still be occurring at the time that the control system (along with the humidity sensor's input information) determines that the second spraying event should commence. In that circumstance, there would not necessarily need to be a period of elapsed time in which there is no spraying procedure occurring whatsoever (i.e., there could be an overlap in the first and second spraying events).

In the present invention, the humidity sensor's input information can be used to determine a "correct" time for initiating (or commencing) a spraying event. Such a "correct" time could be used as an absolute control variable, or it could be used in conjunction with other system parameters used by the controller when the controller determines that it is time to initiate (or commence) a spraying event, or perhaps even when it is time to terminate a spraying event.

In one mode of operation of the present invention, the treating apparatus may commence the first spraying event when the relative humidity within the drum volume of the fabric article drying appliance is greater than 40%. For certain fabrics, or for certain drying methodologies, or for use with certain compositions that will be sprayed through the nozzle 24, it is preferred to commence the first spraying event when the relative humidity within the drum volume of the fabric article drying appliance is greater than60%.

In another mode of operation of the present invention, it is preferred to commence the second spraying event when the relative humidity within the drum volume of the fabric article drying appliance is less than40%. For certain fabrics, or for certain drying methodologies, or for use with certain benefit compositions that will be sprayed through the nozzle 24, it is preferred to commence the second spraying event when the relative humidity within the drum volume of the fabric article drying appliance is less than20%, or more preferably when the relative humidity is less than10%.

Another of the sensors that can be used to improve performance is a temperature sensor, such as the temperature sensor 48 depicted on FIG. 5. If a split interval spray methodology is used as described above, the temperature sensor 48 could determine when the fabric article drying appliance has entered into its cool-down cycle, which would typically occur near the end of the overall fabric treatment cycle. In many circumstances, it is beneficial to wait until the cool-down cycle has commenced before beginning the second spraying event, which would ostensibly occur after a first spraying event has commenced and terminated, and also after a certain amount of elapsed time has occurred during which no spraying at all is being performed. However, in a similar manner to that discussed above in relation to the humidity sensor, if a very small load has been selected by the user of the fabric article drying appliance, it may be possible for the first spraying event and the second spraying event to overlap, such that there would be no "true" split interval spraying procedure, because the first spraying event would not have terminated before it became time to begin the second spraying event. Thus there might not be an elapsed time interval during which no spraying at all would be occurring. The temperature sensor may also work as a safety device (e.g., the spray would only be activated if the dryer reaches a predetermined temperature).

Another enhanced performance feature of the present invention when using a high voltage power supply 28, is a possibility of varying the voltage of the electrostatic spray, if desired, to adjust for various humidity conditions within the fabric article drying appliance. At the beginning of the drying cycle, the benefit composition could begin spraying at a voltage of about 4-6 kV, which would typically occur during a condition of relatively high humidity. As the humidity decreases, it may become beneficial to reduce the electrostatic voltage that is applied to the benefit composition being sprayed through the nozzle 24. Accordingly, at a lower humidity (such as near the end of the treatment cycle), a lower output voltage from the high voltage power supply 28 can deliver a sufficient charge/mass ratio with regard to the electrical charge versus the mass of the benefit composition being dispensed through the nozzle 24. As discussed above, a more sophisticated high voltage power 28 supply could be included in the fabric article drying appliance, which would allow the controller to literally control the output voltage that will be imparted onto the electrode, which in turn charges the benefit composition, either within the reservoir 26 or at the nozzle 24 itself.

There may be situations where the output voltage is slowly modulated or varied over time, and some of these situations may actually call for an increase in the output voltage under certain conditions. However, as the humidity decreases within the fabric article drying appliance, it will typically be preferred that the variable output voltage of the high voltage power supply 28 produce a lower voltage magnitude, in which the voltage could be reduced to approximately 1-4 kV, for example, by the end of the fabric treatment cycle.

Another enhancement provided by the present invention is the use of a variable speed motor 32 for driving the pump 30. If the motor 32 is energized by use of a pulse-width modulation control scheme, the PWM duty cycle can be increased as the battery voltage begins to decrease. This will have the effect of controlling the effective output provided by the pump 30, and will attempt to keep the output volume of the pump 30 substantially constant, even when the battery voltage begins to drop as the battery 52 discharges. The exact tolerance to which the "substantially constant" pump output volume is to be held may be left up to the designer's preference, however, a 10% or 20% (or perhaps even a greater percentage) tolerance perhaps would be an improvement over merely allowing the pump's performance to falter, so long as the controller can continue to maintain a greater duty cycle (i.e., until reaching its peak at 100% duty cycle). The battery would tend to be discharged even faster, when using this mode of operation.

At the same time, if a high voltage power supply 28 is used that has a variable output voltage that can be controlled, then that output voltage could also be "increased" as the battery voltage begins to fall, so that the effective output voltage will remain substantially constant, if desired by the system designer. As an alternative design, the input voltage driving the high voltage power supply 28 could be increased as the battery voltage starts to decrease, thereby keeping the voltage to the motor 32 (or to a piezo pump 30—see below) substantially constant. The exact tolerance to which the "substantially constant" effective voltage is to be held may be left up to the designer's preference, however, a 10% or 20% (or perhaps even a greater percentage) tolerance perhaps would be an improvement over merely allowing the voltage to fall without any attempt at correction, so long as the battery can continue to supply enough current to allow the controller to operate. The battery would tend to be discharged even faster, when using this mode of operation.

As noted above, one type of pump 30 that can be used in the present invention is a peristaltic pump, including for use in an electrostatic spraying application. Another preferred type of pump 30 usable in the present invention is an ultrasonic piezo pump, which has the advantage of having no major moving parts. While certain membranes or laminations (or other types of layers) may vibrate in a reciprocating-type fashion, the piezo pumps do not have major moving parts that can wear out, such as rotating shafts and bearings used with a rotary member to displace a liquid or gaseous fluid. Also, reciprocating pumps require major moving parts that can also wear, and thus require some type of bearings or bushings that end up as wear surfaces. An exemplary piezo pump usable in the present invention is manufactured by PAR Technologies, LLC, located in Hampton, Va., and in particular PAR Technologies' "LPD-series" laminated piezo fluid pumps. Pumps manufactured by PAR Technologies can be obtained which draw a relatively low current. Such piezo pumps would not require a separate motor, such as the motor 32 depicted on FIG. 5.

All documents cited in the Detailed Description of the Invention are, in relevant part, incorporated herein by reference; the citation of any document is not to be construed as an admission that it is prior art with respect to the present invention.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A treating system comprising:

a fabric article drying appliance having a chamber and a closure structure, said closure structure having a closed position and at least one open position, said closure structure allowing access to said chamber; a source of benefit composition; a nozzle in communication with said chamber; a dispensing apparatus that compels benefit composition from said source of benefit composition toward said nozzle, thereby spraying said benefit composition into said chamber; a closure structure sensor;

a control circuit that initiates spraying of said benefit composition, wherein said control circuit prevents said benefit composition from being sprayed when said closure structure sensor indicates that said closure structure is not in said closed position;

a charging circuit that imparts an electrical charge to said benefit composition, thereby generating an electrostatic spray; wherein:

(a) said control circuit comprises at least one of: (i) a sequential processing apparatus, (ii) a parallel processing apparatus, (iii) a logic state machine apparatus, and (iv) discrete analog and logic electronic circuitry:

(b) said source of benefit composition comprises a reservoir;

(c) said charging circuit comprises a high voltage power supply;

(d) said dispensing apparatus that compels said benefit composition comprises a pump apparatus;

and further comprising:

an electrical conductor that carries an output voltage from said high voltage power supply to an electrode, which thereby charges said benefit composition; and an electrical power source wherein said treating system further comprises (a) a first enclosure, (b) a second enclosure, (c) an electrical cable in communication with said first and second enclosures; and (d) an electric motor that actuates said pump apparatus; and wherein:

(e) said first enclosure is located in an exterior relationship to said fabric article drying appliance, and said first enclosure comprises: (i) said electrical power source; and (ii) said control circuit;

(f) said second enclosure is located in an interior relationship to said fabric article drying appliance, and said second enclosure comprises: (i) said reservoir, initially containing said benefit composition; (ii) said high voltage power supply; (iii) said pump apparatus; (iv) said electric motor; (v) said electrode, and said electrical conductor carrying the output voltage to the electrode; (vi) said nozzle; and (viii) said closure structure sensor; and (g) said electric cable carries: (i) electrical energy from said electrical power source to said high voltage power supply, (ii) at least one signal from said control circuit to said electric motor; and (iii) at least one signal from said closure structure sensor to said control circuit.

2. The treating system as recited in claim 1, wherein said closure structure sensor comprises: (a) a light-sensitive device; (b) a pressure-sensitive conductor; or a combination thereof.

3. The treating system as recited in claim 1, further comprising: a motion sensor, wherein said chamber may be placed into motion during operation; and wherein said control circuit prevents said benefit composition from being sprayed when said motion sensor indicates that said movable chamber is not in motion.

4. The treating system as recited in claim 1, further comprising: a motion sensor;

wherein said chamber may have induced air movement therewithin during operation; and wherein said control circuit prevents said benefit composition from being sprayed when said motion sensor indicates that there is not sufficient air movement presently occurring within said chamber.

5. The treating system as recited in claim 1, wherein said charging circuit comprises a high voltage power supply having a variable output voltage that is controlled by said control circuit, and wherein said control circuit is further configured to vary said output voltage of the high voltage power supply that is imparted to said benefit composition such that a first output voltage is generated during a first spraying interval of a spraying event, and a second, different output voltage is generated during a second spraying interval of said spraying event.

6. The treating system as recited in claim 5, wherein said first spraying interval and said second spraying interval are separated in time, thereby causing said treating system to exhibit said first spraying interval, then to preclude spraying, and then to exhibit said second spraying interval.

7. The treating system as recited in claim 6, further comprising a humidity sensor mounted in communication with said chamber, wherein said second spraying interval commences when said humidity sensor determines that a critical moisture content has been achieved in said fabric article drying appliance.

8. The treating system as recited in claim 6, further comprising: a humidity sensor mounted in communication with said chamber, wherein said control circuit is further configured to:

(a) commence said first spraying interval when said humidity sensor determines that a relative humidity in said fabric article drying appliance is pester than 40%;

(b) commence said second spraying interval when said humidity sensor determines that a relative humidity in said fabric article drying appliance is less than 40%;

(c) or a combination thereof.

9. The treating system as recited in claim 6, further comprising a temperature sensor mounted in communication with said chamber, wherein said second spraying interval commences when said temperature sensor determines that a cool-down cycle of said fabric article drying appliance is in progress.

10. The treating system as recited in claim 1, further comprising a temperature sensor mounted in communication with said chamber, wherein said control circuit prevents said benefit composition from being sprayed when said temperature sensor indicates that said fabric article drying appliance is not properly operating.

11. The treating system as recited in claim 1, further comprising:

a voltage sensing circuit; and an electric motor that actuates said pump apparatus; and wherein:

(a) said electrical power source comprises a battery;

(b) said voltage sensing circuit determines an output voltage produced by said battery;

(c) said control circuit generates a pulse-width modulated variable output signal that controls said electric motor; and (d) said control circuit is further configured to increase a duty cycle of said pulse-width modulated variable output signal as said battery-produced output voltage decreases, thereby causing said pump apparatus to provide a substantially constant volume of said benefit composition to said nozzle even though said battery has become partially discharged such that it cannot maintain its rated output voltage.

12. The treating system as recited in claim 1, further comprising:

a voltage sensing circuit; and wherein:

(a) said electrical power source comprises a battery;

(b) said voltage sensing circuit determines an output voltage produced by said battery; and (c) said control circuit is further configured to maintain said variable output voltage of the high voltage power supply at a substantially constant magnitude as said battery-produced output voltage decreases when said battery has become partially discharged such that it cannot maintain its rated output voltage.

13. The treating system as recited in claim 1, further comprising:

(a) an enclosure that is mounted at an interior location of said fabric article drying appliance, and (b) an electric motor that actuates said pump apparatus; and wherein:

said enclosure contains (i) said electrical power source; (ii) said control circuit; (iii) said reservoir, initially containing said benefit composition; (iv) said high voltage power supply; (v) said pump apparatus; (vi) said electric motor; (vii) said electrode, and said electrical conductor carrying the output voltage to the electrode; (viii) said nozzle; and (ix) said closure structure sensor.

14. The treating system as recited in claim 1, wherein a spraying event comprises a first spraying interval and a second spraying interval, wherein said first spraying interval and said second spraying interval are separated in time, thereby causing said treating system to exhibit said first spraying interval, then to preclude spraying, and then to exhibit said second spraying interval.

15. The treating system as recited in claim 14, further comprising a humidity sensor mounted in communication with said chamber, wherein said second spraying interval commences when said humidity sensor determines that a critical moisture content has been achieved in said fabric article drying appliance.

16. The treating system as recited in claim 14, further comprising a temperature sensor mounted in communication with said chamber, wherein said second spraying interval commences when said temperature sensor determines that a cool-down cycle of said fabric article drying appliance is in progress.

* * * * *